US011514831B2

(12) United States Patent
Bae et al.

(10) Patent No.: US 11,514,831 B2
(45) Date of Patent: Nov. 29, 2022

(54) ELECTRONIC DEVICE AND METHOD FOR CONTROLLING STORAGE OF CONTENT DISPLAYED ON DISPLAY PANEL

(71) Applicant: Samsung Electronics Co., Ltd., Gyeonggi-do (KR)

(72) Inventors: Jongkon Bae, Gyeonggi-do (KR); Yohan Lee, Gyeonggi-do (KR); Yunpyo Hong, Gyeonggi-do (KR); Dongkyoon Han, Gyeonggi-do (KR)

(73) Assignee: Samsung Electronics CO., LTD., Suwon-si (KR)

( * ) Notice: Subject to any disclaimer, the term of this patent is extended or adjusted under 35 U.S.C. 154(b) by 0 days.

(21) Appl. No.: 16/971,835

(22) PCT Filed: Feb. 22, 2019

(86) PCT No.: PCT/KR2019/002182
§ 371 (c)(1),
(2) Date: Aug. 21, 2020

(87) PCT Pub. No.: WO2019/164323
PCT Pub. Date: Aug. 29, 2019

(65) Prior Publication Data

US 2021/0082330 A1 Mar. 18, 2021

(30) Foreign Application Priority Data

Feb. 23, 2018 (KR) ..... 10-2018-0021915

(51) Int. Cl.
*G09G 3/20* (2006.01)

(52) U.S. Cl.
CPC ..... *G09G 3/20* (2013.01); *G09G 2360/12* (2013.01)

(58) Field of Classification Search
CPC ..... G09G 3/20; G09G 2360/12; G09G 2360/128; G09G 5/001; G09G 5/005;
(Continued)

(56) References Cited

U.S. PATENT DOCUMENTS 6,407,723 B1 * 6/2002 Okuno ..... G09G 5/005 345/213
8,605,217 B1 * 12/2013 Lafon ..... H04N 21/4305 348/497

(Continued)

FOREIGN PATENT DOCUMENTS

CN 103151025 A 6/2013
JP 2005-0242081 A 9/2005

(Continued)

OTHER PUBLICATIONS

Notice of Preliminary Rejection dated Mar. 29, 2022.
Notice of Final Rejection dated Aug. 4, 2022.

*Primary Examiner* — Fred Tzeng
(74) *Attorney, Agent, or Firm* — Cha & Reiter, LLC

(57) ABSTRACT

An electronic device according to various embodiments may comprise: a display; a processor; a memory; and a display drive circuit for driving the display panel, wherein the display drive circuit is configured to: receive first frame data including at least a part of a second content from the processor while a first content is displayed using the display panel; keep from storing the received first frame data in the memory at least temporarily for a designated period of time; receive second frame data including at least a part of the second content from the processor after the designated period of time; store the received second frame data in the memory; and display the second content on the display panel according to the second frame data.

14 Claims, 15 Drawing Sheets

(58) Field of Classification Search
CPC ..... G09G 5/12; G09G 5/18; G09G 5/393; G09G 5/395; G09G 5/397
See application file for complete search history.

(56) References Cited

U.S. PATENT DOCUMENTS

| | | | | |
|---|---|---|---|---|
| 2008/0174540 | A1 | 7/2008 | Lee | |
| 2010/0317408 | A1* | 12/2010 | Ferren | H04W 52/0209 455/566 |
| 2011/0285683 | A1 | 11/2011 | Todorovich et al. | |
| 2013/0082954 | A1 | 4/2013 | Azumi et al. | |
| 2013/0147822 | A1 | 6/2013 | Yu et al. | |
| 2015/0042668 | A1 | 2/2015 | Jeon | |
| 2015/0221261 | A1* | 8/2015 | Asai | G09G 5/001 345/534 |
| 2016/0078851 | A1* | 3/2016 | Asai | G09G 5/18 345/555 |
| 2016/0117978 | A1* | 4/2016 | Shikata | G09G 3/2096 345/690 |
| 2017/0308226 | A1 | 10/2017 | Yoo et al. | |
| 2018/0322823 | A1* | 11/2018 | Alousi | G09G 3/2096 |

FOREIGN PATENT DOCUMENTS

| | | | |
|---|---|---|---|
| JP | 2013-0076795 | A | 4/2013 |
| JP | 2014-215558 | A | 11/2014 |
| KR | 10-2008-0069483 | A | 7/2008 |
| KR | 10-2010-0052623 | A | 5/2010 |
| KR | 10-2013-0108510 | A | 10/2013 |
| KR | 10-2015-0018029 | A | 2/2015 |
| KR | 10-2017-0113011 | A | 10/2017 |
| KR | 10-2017-0119967 | A | 10/2017 |

* cited by examiner

ELECTRONIC DEVICE AND METHOD FOR CONTROLLING STORAGE OF CONTENT DISPLAYED ON DISPLAY PANEL

CROSS-REFERENCE TO RELATED APPLICATION(S)

This application is a National Phase Entry of PCT International Application No. PCT/KR2019/002182, which was filed on Feb. 22, 2019, and claims priority to Korean Patent Application No. 10-2018-0021915, which was filed on Feb. 23, 2018, the contents of which are incorporated herein by reference.

TECHNICAL FIELD

The disclosure relates to an electronic device for controlling storage of content displayed on a display and a method thereof.

BACKGROUND ART

Electronic devices such as smart phones, tablet Personal Computers (PCs), and smart watches may display various kinds of content, including images and text, through a display panel. The display panel may be driven through a display-driving circuit.

The display-driving circuit may store data for content to be displayed through a plurality of pixels included in the display panel in units of frames and display the content through the display panel according to a predetermined time signal.

DISCLOSURE OF INVENTION

Technical Problem

A processor included in an electronic device may acquire frame data including content to be displayed through a display panel. Meanwhile, the processor may transmit the frame data to the display-driving circuit in order to display the content on the basis of the frame data. While the time at which the frame data is acquired is determined by the processor, the time at which the frame data is transmitted to the display-driving circuit is determined by the display-driving circuit, and thus an operation of acquiring the frame data and an operation of transmitting the frame data may be independent from each other. Due to such independency, the processor transmits frame data including some of the content to the display-driving circuit before completing acquisition of the content, so the quality of a screen displayed through the display panel on the basis of the frame data may be deteriorated.

The technical subjects pursued in the disclosure may not be limited to the above mentioned technical subjects, and other technical subjects which are not mentioned may be clearly understood, through the following descriptions, by those skilled in the art to which the disclosure pertains.

Solution to Problem

In accordance with an aspect of the disclosure, an electronic device is provided. The electronic device includes: a display panel; a processor; and a display-driving circuit including a memory and configured to drive the display panel, wherein the display-driving circuit is configured to receive first frame data including at least a portion of second content from the processor while first content is displayed through the display panel, prevent storage of the received first frame data in the memory at least temporarily for a predetermined time, receive second frame data including at least a portion of the second content from the processor after the predetermined time, store the received second frame data in the memory, and display the second content through the display panel according to the second frame data.

In accordance with another aspect of the disclosure, an electronic device is provided. The electronic device includes: a display panel; a display-driving circuit, which includes a memory and is operatively coupled to the display panel; and a processor operatively coupled to the display-driving circuit, wherein the display-driving circuit is configured to display first content, receive a command indicating a delay time from the processor, discard first frame data on second content received from the processor for the delay time starting from a predetermined time by delaying activation of the memory for the delay time starting from the predetermined time, generate a signal for activating the memory after the delay time from the predetermined time, store second frame data on the second content received from the processor after the delay time from the predetermined time in the memory activated based on the signal, and display the second content changed from the first content, based on the stored second frame data.

In accordance with another aspect of the disclosure, an electronic device is provided. The electronic device includes: a display panel; a display-driving circuit (display-driving integrated circuit), which includes a memory and is operatively coupled to the display panel; and a processor operatively coupled to the display-driving circuit, wherein the display-driving circuit is configured to store first frame data in the memory after a first time elapses from a time at which the first frame data related to first content is initially received from the processor and store second frame data in the memory after a second time, different from the first time, elapses from the time at which the second frame data related to second content different from the first content is initially received from the processor.

In accordance with another aspect of the disclosure, a method of an electronic device is provided. The method includes receiving first frame data including at least a portion of second content from a processor of the electronic device while first content is displayed through the display panel by a display-driving circuit of the electronic device, preventing storage of the received first frame data in the memory at least temporarily for a predetermined time by the display-driving circuit, receiving second frame data including at least a portion of the second content from the processor after the predetermined time by the display-driving circuit, storing the received second frame data in the memory included in the display-driving circuit, and displaying the second content through the display panel according to the second frame data by the display-driving circuit.

In accordance with another aspect of the disclosure, a method of an electronic device is provided. The method includes displaying first content by a display-driving circuit of the electronic device, receiving a command indicating a delay time from a processor of the electronic device by the display-driving circuit of the electronic device, discarding first frame data on second content received from the processor for the delay time starting from a predetermined time by delaying activation of the memory for the delay time starting from the predetermined time by the display-driving circuit, generating a signal for activating the memory after the delay time from the predetermined time by the display-driving circuit, storing second frame data on the second content received from the processor after the delay time from the predetermined time in the memory activated based on the signal by the display-driving circuit, and displaying the second content changed from the first content, based on the stored second frame data by the display-driving circuit.

In accordance with another aspect of the disclosure, a method of an electronic device is provided. The method includes storing first frame data in the memory after a first time elapses from a time at which the first frame data related to first content is initially received from a processor of the electronic device by a display-driving circuit of the electronic device and storing second frame data in the memory after a second time, different from the first time, elapses from the time at which the second frame data related to second content, different from the first content, is initially received from the processor by the display-driving circuit.

Advantageous Effects of Invention

An electronic device and a method thereof according to various embodiments can display content having enhanced quality by controlling the time at which frame data of the content is stored in a memory within a display-driving circuit.

Effects obtainable from the disclosure may not be limited to the above mentioned effects, and other effects which are not mentioned may be clearly understood, through the following descriptions, by those skilled in the art to which the disclosure pertains.

BEST MODE FOR CARRYING OUT THE INVENTION

Figure 1:
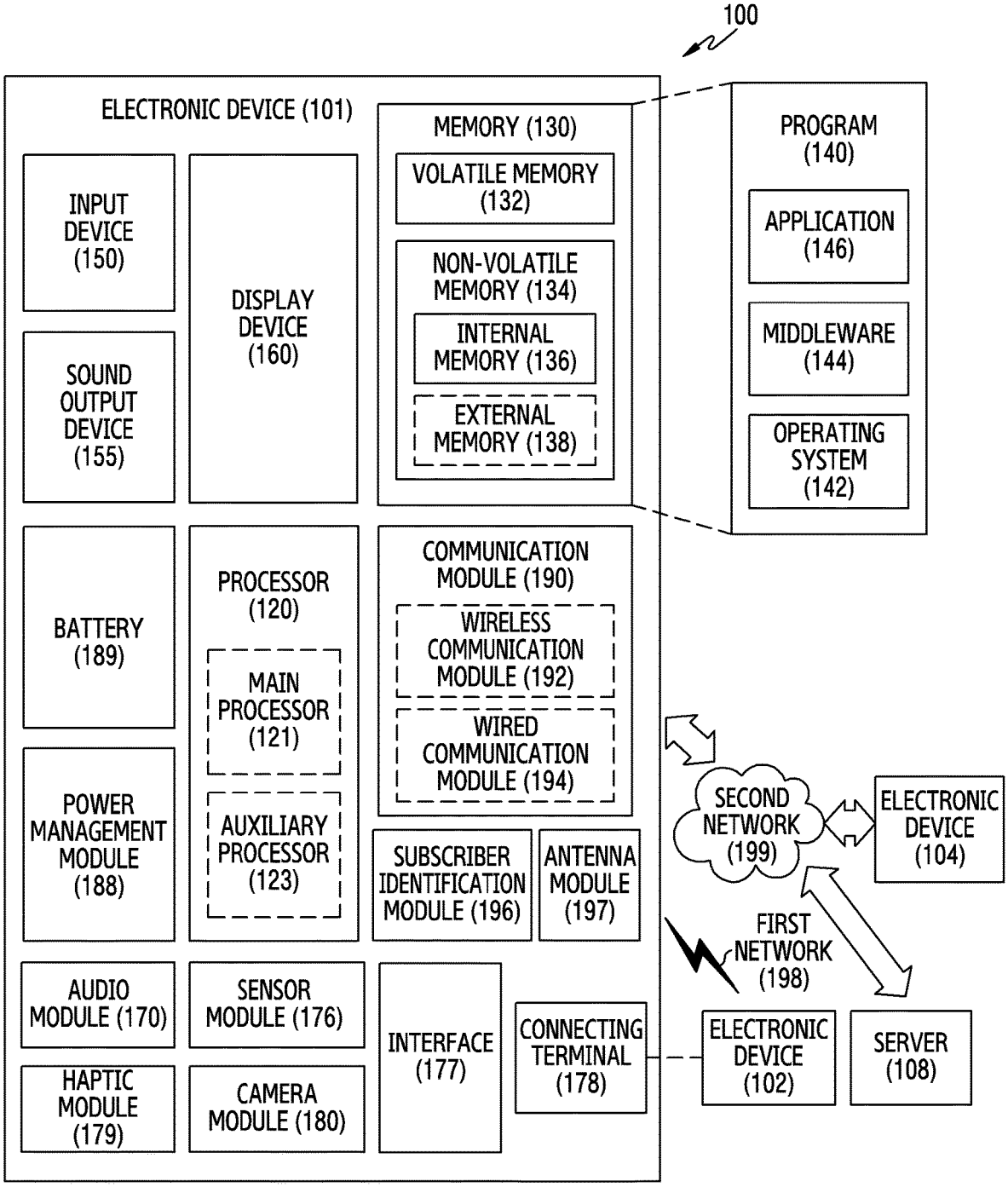
FIG. 1 is a block diagram of an electronic device within a network environment for controlling the time at which frame data on content is stored according to various embodiments.

FIG. 1 is a block diagram of an electronic device within a network environment for controlling the time at which frame data on content is stored according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
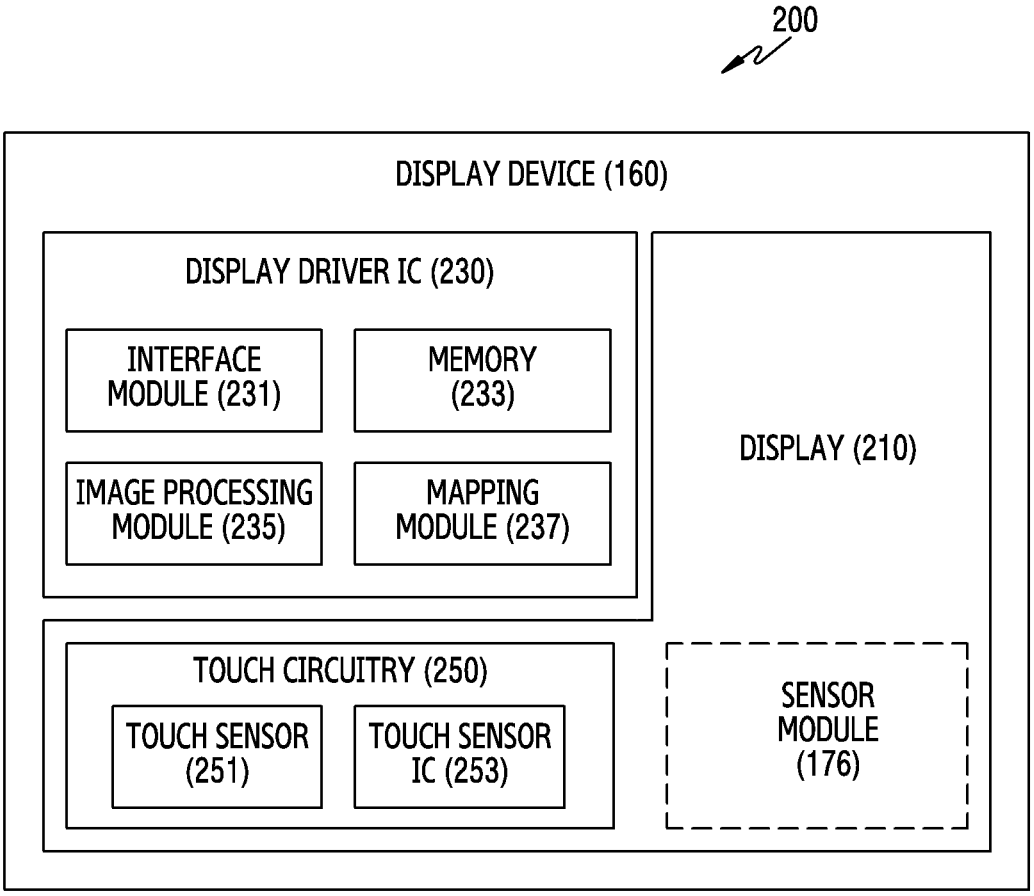
FIG. 2 is a block diagram of a display device for controlling the time at which frame data on content is stored according to various embodiments.

FIG. 2 is a block diagram of a display device for controlling the time at which frame data on content is stored according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
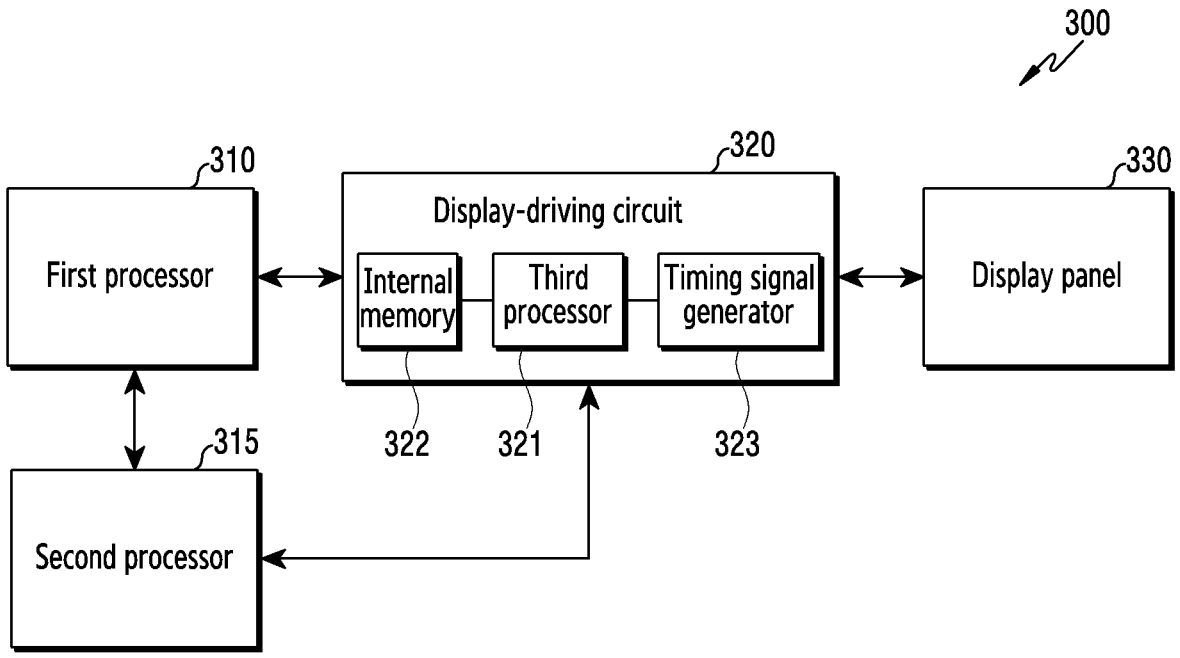
FIG. 3 illustrates an example of the functional configuration of an electronic device according to various embodiments.

FIG. 3 illustrates an example of the functional configuration of an electronic device according to various embodiments. The functional configuration may be included in the electronic device 101 illustrated in FIG. 1.

Referring to FIG. 3, an electronic device 300 may include a first processor 310, a second processor 315, a display-driving circuit 320, and a display panel 330.

The first processor 310 may include the main processor 121 illustrated in FIG. 1, the second processor 315 may include the auxiliary processor 123 illustrated in FIG. 1, the display-driving circuit 320 may include the display driver IC 230 illustrated in FIG. 2, and the display panel 330 may include the display 210 illustrated in FIG. 2.

According to various embodiments, the first processor 310 may generate, acquire, or configure frame data of first content to be provided or transmitted to the display-driving circuit 320.

According to various embodiments, the first processor 310 may generate the frame data including the first content to be displayed while a normal mode is provided. According to various embodiments, the normal mode may be a mode in which the first processor 310 displays a screen through the display panel 330 during a woken-up state. According to various embodiments, the woken-up state may be a state in which a Power Management Integrated Circuit (PMIC) (not shown) of the electronic device 300 provides steady-state power to the first processor 310. According to various embodiments, the normal mode may be a mode in which the first processor 310 displays a screen through the display panel 330 by controlling the display-driving circuit 320. The first processor 310 may operate in the woken-up state while the screen is displayed on the basis of the normal mode. According to various embodiments, the normal mode may be a mode in which the first processor 310 transfers the frame data including the first content to be displayed through the display panel 330 to the display-driving circuit 320.

According to various embodiments, the frame data including the first content to be displayed while the normal mode is provided may be acquired by configuring a single layer. The frame data including the first content to be displayed while the normal mode is provided may be acquired by synthesizing or configuring multiple layers. The frame data including the first content to be displayed while the normal mode is provided may include a plurality of objects. According to various embodiments, the plurality of objects may be combined to display the content through the display panel 330. For example, the plurality of objects may be associated or concatenated with each other in order to provide animation. The plurality of objects may be sequentially scanned or read by the display-driving circuit 320 to provide an animation.

According to various embodiments, the first processor 310 may generate the frame data including the first content to be displayed while the AOD mode is provided. For example, the processor may generate the frame data including the first content to be displayed while the AOD mode is provided on the basis of detection of a change in the driving mode of the electronic device 300 from the normal mode to the AOD mode. In another example, the first processor 310 may generate the frame data including the first content to be displayed while the AOD mode is provided on the basis of detection of an event for changing the content to the first content in the state in which the electronic device enters the AOD mode (for example, reception of a message from an external electronic device while the AOD mode is provided). According to various embodiments, the AOD mode may be a mode in which the first processor 310 displays a screen through the display panel 330 while the first processor 310 is in a sleep state. According to various embodiments, the sleep state may be a turned-off state in which booting is required in order to switch to the woken-up state. According to various embodiments, the sleep state may be a state in which a PMIC (not shown) of the electronic device 300 limits (for example, stops) the provision of power to the first processor 310. According to various embodiments, the sleep state may be a state in which the first processor 10 does not require booting to switch to the active state but needs to receive normal power from the PMIC. According to various embodiments, the sleep state may be a state in which power lower than a reference power is received from the PMIC of the electronic device 300. According to various embodiments, the sleep state may include one or more of an inactive state, an idle state, a standby state, or a low-power state. According to various embodiments, the AOD mode may be a mode in which the first processor 310 is in the sleep state during at least some of intervals in which the screen is displayed through the display panel 330. According to various embodiments, the AOD mode may be a mode in which power is acquired from the internal power of the display-driving circuit 320. According to various embodiments, the AOD mode may be considered a self-display mode from the aspect of screen display according to the operation of the display-driving circuit 320 itself. According to various embodiments, the AOD mode may include a plurality of sub modes. For example, the AOD mode may include an AOD self-animation mode. The AOD self-animation mode may be a mode in which the display-driving circuit 320 provides animation through the display panel 330 by sequentially scanning a plurality of images included in frame data stored in the internal memory 322 within the display-driving circuit 320 while the first processor 310 is in the sleep state. For example, the AOD mode may include an AOD non-self-animation mode. The AOD non-self-animation mode may be a mode in which, when an event is detected during the AOD mode, animation is provided using frame data provided in every frame from the first processor 310 on the basis of the detected event. For example, when a message is received from an external electronic device during the AOD mode, the first processor 310 may switch from the sleep mode to the wake-up mode in the state in which the AOD mode is provided, and may transmit frame data in every frame to the display-driving circuit 320 in order to provide the animation in every frame after switching. The display-driving circuit 320 may provide animation related to reception of the message on the basis of the frame data received in every frame. For example, the display-driving circuit 320 may display a notification indicating reception of the message in an edge area (or a boundary area) of the display panel 330 in the form of an animation on the basis of the frame data received in every frame.

According to various embodiments, the frame data including the first content to be displayed while the AOD mode is provided may be acquired by configuring a single layer. The frame data including the first content to be displayed while the AOD mode is provided may be acquired by synthesizing or configuring multiple layers. The frame data including the first content to be displayed while the AOD mode is provided may include a plurality of objects. According to various embodiments, the plurality of objects may be combined to display the first content through the display panel 330. For example, the plurality of objects may be associated or concatenated with each other to provide animation. The plurality of objects may be sequentially scanned or read by the display-driving circuit 320 to provide an animation.

According to various embodiments, the first processor 310 may provide or transmit the frame data including the first content to the display-driving circuit 320. According to various embodiments, the first processor 310 may provide or transmit the frame data including the first content to be displayed while the AOD mode is provided to the display-driving circuit 320. According to various embodiments, the first processor 310 may provide or transmit the frame data including the first content to be displayed while the normal mode is provided to the display-driving circuit 320. According to various embodiments, the first processor 310 may transmit the frame data through a Mobile Industry Processor Interface (MIPI. For example, the first processor 310 may transmit the frame data through at least one of a command of 2Ch of an MIPI standard or a command of 3Ch of an MIPI standard. According to various embodiments, the first processor 310 may compress the frame data in order to transmit the frame data to the display-driving circuit 320. The first processor 310 may transmit the compressed frame data to the display-driving circuit 320.

According to various embodiments, the first processor 310 may transmit the frame data to the display-driving circuit 320 on the basis of a synchronization signal received from the display-driving circuit 320. According to various embodiments, the synchronization signal may be used to control the time at which the frame data is recorded or stored in the internal memory 322. According to various embodiments, the synchronization signal may be generated or acquired by a timing signal generator 323 included in the display-driving circuit 320. According to various embodiments, the synchronization signal may be transmitted to the first processor 310 by the timing signal generator 323 included in the display-driving circuit 320. According to various embodiments, the first processor 310 may transmit the frame data to the display-driving circuit 320 in response to reception of the synchronization signal.

According to various embodiments, the display-driving circuit 320 may receive the frame data including the first content. According to various embodiments, the display-driving circuit 320 may store the frame data in the internal memory 322 included in the display-driving circuit 322 through the third processor 321. According to various embodiments, the display-driving circuit 320 may scan the frame data stored in the memory 322 through the third processor 321. According to various embodiments, the third processor 321 may include one or more of a timing controller, an interface controller, a command controller, and a GRAM controller.

According to various embodiments, the display-driving circuit 320 may display the first content through the display panel 330 by scanning the frame data on the basis of a timing signal (for example, a vertical synchronization signal and/or a horizontal synchronization signal) generated or acquired by the timing signal generator 323.

According to various embodiments, the first processor 310 may be in the woken-up state for the normal mode while the first content is being displayed. According to various embodiments, the first processor 310 may be in a sleep state for the AOD mode while the first content is being displayed.

According to various embodiments, the second processor 315 may detect an event related to the electronic device 300 while the first processor 310 is in the sleep state. The event may indicate the context in which a change in the display of the content provided in the AOD mode is needed. For example, the event may include reception of a Short Messaging Service (SMS) message, a Multimedia Messaging Service (MMS) message, or a message related to a message application from another electronic device. In another example, the event may include acquisition of information such as weather or news from another electronic device. In another example, the event may include a reduction in the remaining charge of a battery (not shown) of the electronic device 300. However, this is not limiting.

The second processor 315 may transmit a signal indicating detection of the event (hereinafter, referred to as an event detection signal) to the first processor 310 or the PMIC (not shown) in the electronic device 300. The first processor 310 may switch from the sleep state to the woken-up state on the basis of the event detection signal. In some embodiments, the second processor 315 may directly transmit the event detection signal to the display-driving circuit 320. For example, the second processor 315 may transmit the event detection signal to the display-driving circuit 320 while the first processor 310 is in the sleep state. In this case, the event detection signal may include control information related to input performed on the electronic device 300 (for example, touch input) or control information for changing at least some of data included in the first image (for example, control information for correcting an error in time indicated by a clock when the first image is the clock). For example, when the second processor 315 is the touch sensor IC 253 included in the touch circuit 250 of FIG. 2, the second processor 315 may provide information on a touch input signal acquired through the touch sensor 251 to the display-driving circuit 320.

According to various embodiments, the first processor 310 or the second processor 315 may detect an event for changing the first content to second content while the first content is being displayed. According to various embodiments, the event may include detection of user input for changing the first content to the second content by the first processor 310 or the second processor 315. According to various embodiments, the event may include detection of elapse of a specified time after the first content is displayed. However, this is not limiting.

According to various embodiments, the first processor 310 may generate or acquire the second content on the basis of the detection.

According to various embodiments, the first processor 310 may generate or acquire the frame data including the second content to be displayed while the normal mode is provided. According to various embodiments, the frame data including the second content to be displayed while the normal mode is provided may be acquired by configuring a single layer. The frame data including the second content to be displayed while the normal mode is provided may be acquired by synthesizing or configuring multiple layers. The frame data including the second content to be displayed while the normal mode is provided may include a plurality of objects. According to various embodiments, the plurality of objects may be combined to display the content through the display panel 330. For example, the plurality of objects may be concatenated with each other in order to provide the animation. The plurality of objects may be sequentially scanned or read by the display-driving circuit 320 to provide animation.

According to various embodiments, the first processor 310 may generate the frame data including the second content to be displayed while an AOD mode is provided. According to various embodiments, the frame data including the second content to be displayed while the AOD mode is provided may be acquired by configuring a single layer. The frame data including the second content to be displayed while the AOD mode is provided may be acquired by synthesizing or configuring multiple layers. The frame data including the second content to be displayed while the AOD mode is provided may include a plurality of objects. According to various embodiments, the plurality of objects may be combined to display the second content through the display panel 330. For example, the plurality of objects may be associated or concatenated with each other to provide animation. The plurality of objects may be sequentially scanned or read by the display-driving circuit 320 to provide animation.

According to various embodiments, the time required to generate the frame data including the second content may vary depending on the load on the first processor 310. For example, when the first processor 310 performs a relatively small task, the first processor 310 consumes an amount of a first time to complete generation of the frame data. However, when the first processor 310 performs a relatively large task, the first processor 310 may consume an amount of a second time, longer than the first time, to complete generation of the frame data.

According to various embodiments, the time required to generate the frame data including the second content may vary depending on a level of charge of a battery included in the electronic device 300. For example, when the level of charge of the battery is lower than a reference level, the electronic device 300 may change the operation frequency of the first processor 310 from a first operation frequency to a second operation frequency lower than the first operation frequency. For example, the first operation frequency may be an operation frequency in a state in which the level of charge of the battery is higher than or equal to the reference level (that is, a steady-power state), and the second operation frequency may be an operation frequency in a state in which the level of charge of the battery is lower than the reference level. When the first processor 310 operates on the basis of the first operation frequency, the first processor 310 may consume a first time to complete generation of the frame data. However, when the first processor 310 operates on the basis of the second operation frequency, which is lower than the first operation frequency, the first processor 310 may consume a second time, longer than the first time, to complete generation of the frame data.

According to various embodiments, the time required to generate the frame data may vary depending on the configuration of the content. For example, the first processor 310 may consume the first time to complete generation of frame data including the second content having a single layer, but may consume the second time, longer than the first time, to complete generation of the frame data including the second content having multiple layers.

According to various embodiments, the time required to generate the frame data may vary depending on the number of objects included in the second content. For example, the first processor 310 may consume the first time to complete generation of frame data including the second content having a relatively small number of objects, but may consume the second time, longer than the first time, to complete generation of frame data including second content having a relatively large number of objects.

According to various embodiments, the first processor 310 may provide or transmit the frame data including the second content to the display-driving circuit 320. According to various embodiments, the first processor 310 may provide or transmit the frame data including the second content to be displayed while the AOD mode is provided to the display-driving circuit 320. According to various embodiments, the first processor 310 may provide or transmit the frame data including the second content to be displayed while the normal mode is provided to the display-driving circuit 320. According to various embodiments, the first processor 310 may transmit the frame data including the second content through a Mobile Industry Processor Interface (MIPI). For example, the first processor 310 may transmit the frame data including the second content through at least one of a command of 2Ch of an MIPI standard or a command of 3Ch of an MIPI standard. According to various embodiments, the first processor 310 may compress the frame data including the second content in order to transmit the frame data to the display-driving circuit 320. The first processor 310 may transmit the compressed frame data to the display-driving circuit 320.

According to various embodiments, the first processor 310 may transmit the frame data including the second content to the display-driving circuit 320 on the basis of a synchronization signal received from the display-driving circuit 320.

According to various embodiments, while generation of the frame data including the second content is performed by the first processor 310, transmission of the frame data including the second content is performed on the basis of the synchronization signal received from the display-driving circuit 320, and thus the generation of the frame data and the transmission of the frame data may be independent from each other. Due to such independency, the first processor 310 may transmit frame data that has not been completely generated (for example, frame data that does not include all of the second content, that is, frame data including only some of the second content) to the display-driving circuit 320.

When the display-driving circuit 320 stores frame data that has not been completely generated and displays a screen on the basis of the stored frame data, the screen may include only some of the second content. Accordingly, a method of limiting storage of the frame data transmitted from the first processor 310 until generation of the frame data including the second content is completed may be required.

According to various embodiments, in order to limit (or prevent) storage of the frame data by the display-driving circuit 320 until the first processor 310 completely generates the frame data, the first processor 310 may transmit information (or a command) to the display-driving circuit 320. According to various embodiments, the information may include data indicating a predetermined time. According to various embodiments, the information may be transmitted from the first processor 310 to the display-driving circuit 320 before initiating transmission of the frame data including at least the portion of the second content. According to various embodiments, the information may be transmitted along with the frame data including at least the portion of the second content. According to various embodiments, the information including the data indicating the predetermined time may include a command different from the command of 2Ch and the command of 3Ch, among commands from 00h to FFh of the MIPI standard. According to various embodiments, the predetermined time may be the time required until generation of the frame data is completed. For example, the first processor 310 may identify the predetermined time on the basis of the load on the first processor 310. In another example, the first processor 310 may identify the predetermined time on the basis of the configuration of content to be displayed through the display panel 330. In another example, the first processor 310 may identify the predetermined time on the basis of the number of objects included in content to be displayed through the display panel 330. However, this is not limiting. According to various embodiments, the predetermined time may be referred to as a delay time from the aspect of delaying storage of the frame data.

According to various embodiments, the predetermined time may be configured with time resources (for example, frames) defined within at least one of the first processor 310 or the display-driving circuit 320.

According to various embodiments, the display-driving circuit 320 may receive the information. According to various embodiments, the display-driving circuit 320 may identify the predetermined time for which storage of the frame data is limited on the basis of the information. According to various embodiments, the display-driving circuit 320 may limit storage of the frame data for the identified predetermined time starting at a predetermined time point. According to various embodiments, the predetermined time may correspond to the time at which the synchronization signal is transmitted from the display-driving circuit 320. According to various embodiments, the predetermined time may correspond to the time at which the synchronization signal is received by the first processor 310. According to various embodiments, the display-driving circuit 320 may limit the storage of the frame data in the internal memory 322 by discarding the frame data including some of the second content received from the first processor 310 for the delay time starting from the predetermined time.

According to various embodiments, the display-driving circuit 320 may store the frame data received from the first processor 310 in the internal memory 322 after the predetermined time. The frame data is received after the predetermined time and thus may be frame data including all of the second content. The display-driving circuit 320 may display the second content in place of the first content through the display panel 330 by scanning the stored frame data through the third processor 321.

According to various embodiments, in order to identify or detect the elapse of the predetermined time, the display-driving circuit 320 may configure a counter value. When the predetermined time is configured in units of frames, the counter value may correspond to the predetermined time. For example, when the time required for the first processor 310 to complete generation of the frame data is 2 frames (that is, 1/30(=2/60) seconds), the counter value may be set to 2.

According to various embodiments, the display-driving circuit 320 may change the counter value in response to reception of the frame data from the first processor 310. For example, the display-driving circuit 320 may decrease (or increase) the counter value on the basis of identification of a predetermined command (for example, a record start command (the command of 2Ch in the MIPI standard)) on the basis of the frame data received from the first processor 310.

According to various embodiments, the display-driving circuit 320 may identify whether the changed counter value reaches a predetermined value. The display-driving circuit 320 may store the frame data received from the first processor 310 in the internal memory 322 without discarding the frame data on the basis of identification that the changed counter value has reached the predetermined value.

For example, when the counter value is 3 and the predetermined value is 0, the display-driving circuit 320 may change the counter value from 3 to 2 on the basis of reception of frame data from the first processor 310 in a first frame, change the counter value from 2 to 1 on the basis of reception of frame data from the first processor 310 in a second frame, change the counter value from 1 to 0 on the basis of reception of frame data from the first processor 310 in a third frame, and store frame data received in a fourth frame in the internal memory 322 on the basis of reception of the frame data from the first processor 310 in the fourth frame. The display-driving circuit 320 may display the second content changed from the first content through the display-driving circuit 330 on the basis of the stored frame data.

In another example, when the counter value is 0 and the predetermined value is 2, the display-driving circuit 320 may change the counter value from 0 to 1 on the basis of reception of frame data from the first processor 310 in a first frame, change the counter value from 1 to 2 on the basis of reception of frame data from the first processor 310 in a second frame, and store frame data received in a third frame in the internal memory 322 on the basis of reception of the frame data from the first processor 310 in the third frame. The display-driving circuit 320 may display the second content changed from the first content through the display-driving circuit 330 on the basis of the stored frame data.

Figure 4:
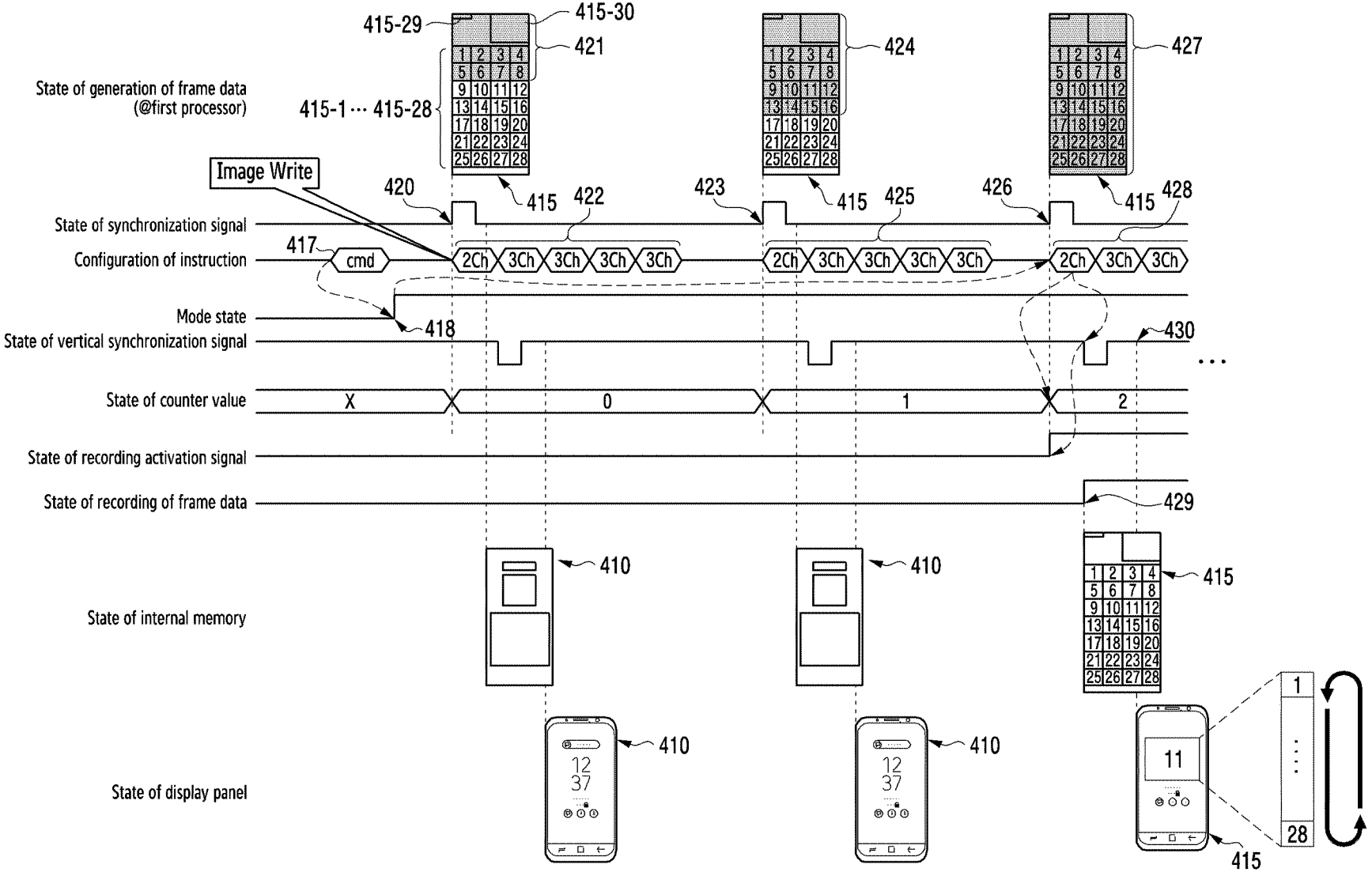
FIG. 4 illustrates an example of signaling between a first processor and a display-driving circuit within an electronic device according to various embodiments.

For example, referring to FIG. 4, the display-driving circuit 320 may display first content 410 through the display panel 330. According to various embodiments, the first content 410 may be content provided in the normal mode. According to various embodiments, the first content 410 may be content distinguished from content for providing animation in the AOD mode. However, this is not limiting.

The first processor 310 or the second processor 315 may detect an event for changing the first content 410 to the second content 415 while the first content 410 is displayed. According to various embodiments, the second content 415 may be content that is provided in the normal mode and requires synthesis of multiple layers. According to various embodiments, the second content 415 may be content that is provided in the normal mode and includes a plurality of objects. According to various embodiments, the second content 415 may be content for providing animation in the AOD mode. When the second content 415 is content for providing the animation in the AOD mode, the second content 415 may include a plurality of objects (objects 415-1 to 415-28) combined to provide the animation. For example, the plurality of objects (objects 415-1 to 415-28) may be associated or concatenated with each other in order to provide the animation. For example, the plurality of objects (objects 415-1 to 415-28) may be used to provide animation by being sequentially scanned by the display-driving circuit 320. According to various embodiments, the second content 415 may further include one or more of an object 415-29 or an object 415-30 having different attributes distinguished from the attributes of each of the plurality of objects (objects 415-1 to 415-28).

According to various embodiments, the first processor 310 may transmit information 417 to the display-driving circuit 320 on the basis of the detection. According to various embodiments, the information 417 may include data indicating the predetermined time for which storage of the frame data including at least the portion of the second content 415 transmitted from the first processor 310 to the display driving circuit 320 in the internal memory 322 is limited. In the example of FIG. 4, the predetermined time may correspond to two frames (that is, 1/30(=2/60) seconds). According to various embodiments, the information 417 may further include other data indicating attributes or characteristics of the second content 415. According to various embodiments, the attributes or characteristics of the second content 415 may be a method of displaying the second content 415. For example, the first processor 310 may transmit the information 417 including data indicating the predetermined data and other data indicating that the second content 415 includes a plurality of objects (objects 415-1 to 415-N) concatenated to provide animation in the AOD mode to the display-driving circuit 320. The display-driving circuit 320 may receive the information 417 from the first processor 310.

According to various embodiments, the display-driving circuit 320 may activate a mode state signal indicating that animation is provided in the AOD mode of the display-driving circuit 320 at time 418 in response to reception of the information 417. The mode state signal may be activated while the animation is provided in the AOD mode through the display panel 330.

According to various embodiments, the display-driving circuit 320 may activate a counter value for monitoring whether the predetermined time has elapsed on the basis of reception of the information 417. According to various embodiments, the display-driving circuit 320 may configure a predetermined value for monitoring whether the predetermined time elapses on the basis of reception of the information 417. In the example of FIG. 4, the predetermined value may be configured as 2, corresponding to the predetermined time (for example, 2 frames).

According to various embodiments, the first processor 310 may generate the frame data including the second content 415 on the basis of the detection. The first processor 310 may receive the synchronization signal from the display-driving circuit 320 while the frame data including the second content 415 is generated. The synchronization signal may be transmitted from the display-driving circuit 320 to the first processor 310 in every frame. For example, the first processor 310 may receive the synchronization signal at time 420 while the frame data including the second content 415 is being generated. The first processor 310 may not completely generate the second content 415 at the time 420 at which the first processor 310 receives the synchronization signal. The first processor 310 may transmit frame data 422 including the part 421 of the second content 415 to the display-driving circuit 320 in response to reception of the synchronization signal at the time 420. According to various embodiments, the frame data 422 may include the command of 2Ch of the MIPI standard indicating start of recording of the frame data and the command of 3Ch of the MIPI standard indicating continuation of recording of the frame data. The display-driving circuit 320 may receive the frame data 422 including the part 421 of the second content 415 from the first processor 310.

According to various embodiments, the display-driving circuit 320 may identify the command of 2Ch from the frame data 422. The display-driving circuit 320 may change the counter value on the basis of the identification. For example, the display-driving circuit 320 may change the counter value from X to 0 on the basis of the identification.

According to various embodiments, the display-driving circuit 320 may maintain a signal for activating the memory 322 (hereinafter, referred to as a recording activation signal) in an inactive (disabled) state on the basis of identification that the counter value (0) has not reached the predetermined value (2). The display-driving circuit 320 may limit storage of the frame data 422 on the basis of maintenance of the inactive state of the recording activation signal. According to various embodiments, the display-driving circuit 320 may limit storage of the frame data 422 by discarding the frame data 422 on the basis of maintenance of the inactive state of the recording activation signal. Meanwhile, the internal memory 322 included in the display-driving circuit 320 may maintain storage of the frame data including the first content 410 due to the limit.

According to various embodiments, the display-driving circuit 320 maintains storage of the frame data including the first content 410 without storing the frame data 422 in the internal memory 322, and thus may maintain the display of the first content 410 through the display panel 330. In other words, the display-driving circuit 320 may display the first content 410 on the basis of frame data stored in the internal memory 322 independently from reception of the frame data 422. The time point at which the first content 410 is displayed may be identified on the basis of the time at which a vertical synchronization signal is acquired.

According to various embodiments, the display-driving circuit 320 may receive the synchronization signal at time 423 while the frame data including the second content 415 is generated. According to various embodiments, the time interval between the time 420 and the time 423 may correspond to 1 frame (that is, one frame (1/60) seconds). The first processor 310 may not completely generate the second content 415 at the time 423 the first processor 310 receives the synchronization signal. The first processor 310 may transmit frame data 425 including the part 424 of the second content to the display-driving circuit 320 in response to reception of the synchronization signal at the time 423. According to various embodiments, the frame data 425 may include the command of 2Ch and the command of 3Ch. The display-driving circuit 320 may receive the frame data 425 including the part 424 of the second content from the first processor 310.

According to various embodiments, the display-driving circuit 320 may identify the command of 2Ch from the frame data 425. The display-driving circuit 320 may change the counter value from 0 to 1 on the basis of the identification.

According to various embodiments, the display-driving circuit 320 may maintain the recording activation signal in the inactive state on the basis of identification that the counter value (1) has not reached the predetermined value (2). The display-driving circuit 320 may limit storage of the frame data 425 on the basis of maintenance of the inactive state of the recording activation signal. According to various embodiments, the display-driving circuit 320 may limit storage of the frame data 425 by discarding the frame data 425 on the basis of maintenance of the inactive state of the recording activation signal. Meanwhile, the internal memory 322 included in the display-driving circuit 320 may maintain storage of the frame data including the first content 410 due to the limit.

According to various embodiments, the display-driving circuit 320 maintains storage of frame data including the first content 410 without storing the frame data 425 in the internal memory 322 and thus may maintain the display of the first content 310 through the display panel 330. In other words, the display-driving circuit 320 may display the first content 410 on the basis of the frame data stored in the internal memory 322 independently from reception of the frame data 425. The time at which the first content 410 is displayed may be identified on the basis of the time at which the vertical synchronization signal is acquired.

According to various embodiments, the display-driving circuit 320 may receive the synchronization signal at time 426 after completing generation of the frame data including the second content 415. According to various embodiments, the time interval between the time 423 and the time 426 may be 1 frame. The first processor 310 may completely generate the second content 415 at time 426 at which the first processor 310 receives the synchronization signal. The first processor 310 may transmit frame data 428 including all of the second content 427 to the display-driving circuit 320 in response to reception of the synchronization signal at the time 426. According to various embodiments, the frame data 428 may include the command of 2Ch and the command of 3Ch. The display-driving circuit 320 may receive the frame data 428 including all of the second content 427 from the first processor 310.

According to various embodiments, the display-driving circuit 320 may identify the command of 2Ch from the frame data 428. The display-driving circuit 320 may change the counter value from 1 to 2 on the basis of the identification.

According to various embodiments, the display-driving circuit 320 may change the recording activation state from the inactive state to the active state on the basis of identification that the counter value (2) has reached the predetermined value (2). For example, the display-driving circuit 320 may switch (or change) the state of the recording activation signal from the inactive state to the active (enable) state at time 426 on the basis of the identification.

According to various embodiments, the display-driving circuit 320 may store frame data 428 in the activated internal memory 322 on the basis of the recording activation signal switched to the active state. For example, the display-driving circuit 320 may initiate storage of the frame data 428 in the activated internal memory 322 at time 429.

According to various embodiments, the display-driving circuit 320 may display at least the portion of the second content 415 through the display panel 330 on the basis of the frame data 428 stored in the internal memory 322. For example, the display-driving circuit 320 may display at least the portion of the second content 415 in place of the first content 410 through the display panel 330 at time 430 on the basis of the frame data 428 stored in the internal memory 322. The time 430 at which the second content 415 is displayed may be identified on the basis of the time at which the vertical synchronization signal is acquired. According to various embodiments, since the display-driving circuit 320 sequentially scans the plurality of objects (objects 415-1 to 415-28) to provide animation, at least the portion of the second content 415 displayed through the display panel 330 may include one object (for example, the object 415-11) among the plurality of objects (objects 415-1 to 415-28).

Figure 5:
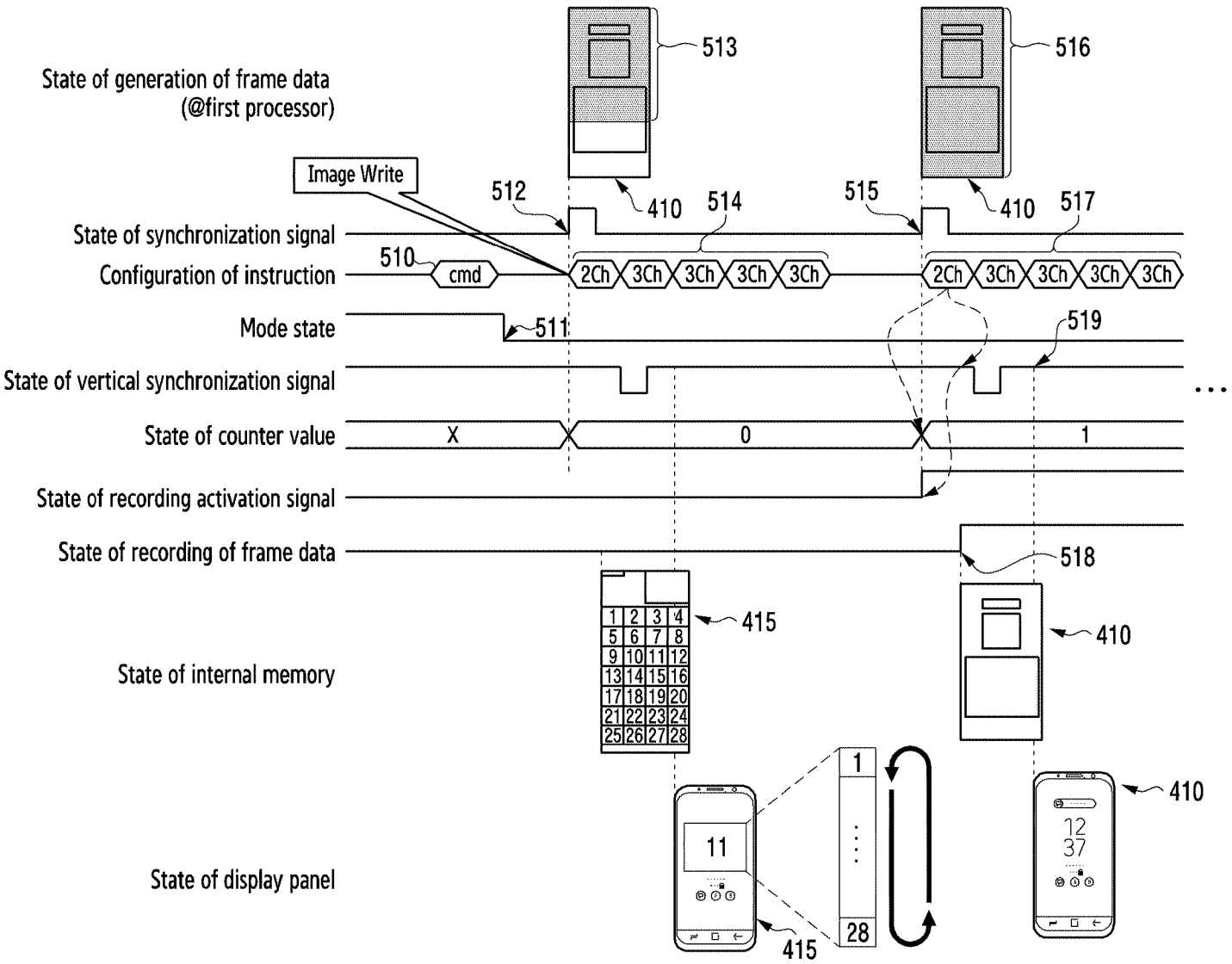
FIG. 5 illustrates another example of signaling between the first processor and the display-driving circuit within the electronic device according to various embodiments.

In another example, referring to FIG. 5, the display-driving circuit 320 may display the second content 415 through the display panel 330. According to various embodiments, the second content 415 may be content that is provided in the normal mode and requires synthesis of multiple layers. According to various embodiments, the second content 415 may be content for providing animation in the AOD mode. However, this is not limiting.

The first processor 310 or the second processor 315 may detect an event for changing the second content 415 to the first content 410 while the second content 415 is being displayed. According to various embodiments, the first content 410 may be content provided in the normal mode. According to various embodiments, the first content 410 may be content distinguished from content for providing animation in the AOD mode. However, this is not limiting.

According to various embodiments, the first processor 310 may transmit information 510 to the display-driving circuit 320 on the basis of the detection. According to various embodiments, the information 510 may include data indicating the predetermined time for which the frame data including at least a portion of the first content 410 transmitted from the first processor 310 to the display-driving circuit 320 is to be stored in the internal memory 322. In the example of FIG. 5, the predetermined time may correspond to 1 frame (that is, 1/60 seconds). According to various embodiments, the information 510 may further include other data indicating attributes or characteristics of the first content 410. According to various embodiments, the attributes or characteristics of the first content 410 may include a method of displaying the first content 410. For example, the first processor 310 may transmit the information 510 including data indicating the predetermined time and other data indicating that the first content 410 is configured to provide at least one image distinguished from the animation in the AOD mode to the display-driving circuit 320. The display-driving circuit 320 may receive the information 510 from the first processor 310.

According to various embodiments, the display-driving circuit 320 may deactivate a mode state signal indicating that animation is provided in the AOD mode of the display-driving circuit 320 at time 511 on the basis of reception of the information 510.

According to various embodiments, the display-driving circuit 320 may activate a counter value for monitoring whether the predetermined time elapses on the basis of reception of the information 510. According to various embodiments, the display-driving circuit 320 may configure a predetermined value for monitoring whether the predetermined time elapses on the basis of reception of the information 510. In the example of FIG. 5, the predetermined value may be configured as 1, corresponding to the predetermined time (for example, 1 frame).

According to various embodiments, the first processor 310 may generate the frame data including the first content 410 on the basis of the detection. The first processor 310 may receive the synchronization signal from the display-driving circuit 320 while the frame data including the first content 410 is generated. The synchronization signal may be transmitted from the display-driving circuit 320 to the first processor 310 in every frame. For example, the first processor 310 may receive the synchronization signal at time 512 while the frame data including the first content 410 is generated. The synchronization signal may indicate a state in which the first processor 310 has not completely generated the first content 410 at the time 512 received by the first processor 310. The first processor 310 may transmit frame data 514 including the part 513 of the first content 410 to the display-driving circuit 320 in response to reception of the synchronization signal at the time 514. According to various embodiments, the frame data 514 may include the command of 2Ch of the MIPI standard indicating start of recording of the frame data and the command of 3Ch of the MIPI standard indicating continuation of recording of the frame data. The display-driving circuit 320 may receive the frame data 514 including the part 513 of the first content 410 from the first processor 310.

According to various embodiments, the display-driving circuit 320 may identify the command of 2Ch from the frame data 514. The display-driving circuit 320 may change the counter value on the basis of the identification. For example, the display-driving circuit 320 may change the counter value from X to 0 on the basis of the identification.

According to various embodiments, the display-driving circuit 320 may maintain a signal for activating the memory 322 (hereinafter, referred to as a recording activation signal) in an inactive (disabled) state on the basis of identification that the counter value (0) has not reached the predetermined value (1). The display-driving circuit 320 may limit storage of the frame data 514 on the basis of maintenance of the inactive state of the recording activation signal. According to various embodiments, the display-driving circuit 320 may limit storage of the frame data 514 by discarding the frame data 514 on the basis of maintenance of the inactive state of the recording activation signal. Meanwhile, the internal memory 322 included in the display-driving circuit 320 may maintain storage of the frame data including the second content 415 due to the limit.

According to various embodiments, the display-driving circuit 320 maintains storage of the frame data including the second content 415 without storing the frame data 514 in the internal memory 322, and thus may maintain the display of the second content 415 through the display panel 330. In other words, the display-driving circuit 320 may display the second content 415 on the basis of frame data stored in the internal memory 322 independently from reception of the frame data 514. The time point at which the second content 415 is displayed may be identified on the basis of the time at which a vertical synchronization signal is acquired.

According to various embodiments, the display-driving circuit 320 may receive the synchronization signal at time 515 after completing generation of the frame data including the first content 410. According to various embodiments, the time interval between the time 512 and the time 515 may correspond to 1 frame. The first processor 310 may completely generates the first content 410 at time 515 at which the first processor 310 receives the synchronization signal. The first processor 310 may transmit frame data 517 including all of the second content 516 to the display-driving circuit 320 in response to reception of the synchronization signal at the time 515. According to various embodiments, the frame data 517 may include the command of 2Ch and the command of 3Ch. The display-driving circuit 320 may receive the frame data 517 including all of the second content 516 from the first processor 310.

According to various embodiments, the display-driving circuit 320 may identify the command of 2Ch from the frame data 517. The display-driving circuit 320 may change the counter value from 0 to 1 on the basis of the identification.

According to various embodiments, the display-driving circuit 320 may change the state of the recording activation state from the inactive state to the active state on the basis of identification that the counter value (1) reaches the predetermined value (1). For example, the display-driving circuit 320 may switch (or change) the state of the recording activation signal from the inactive state to the active (enable) state at time 515 on the basis of the identification.

According to various embodiments, the display-driving circuit 320 may store the frame data 517 in the activated internal memory 322 on the basis of the recording activation signal switched to the active state. For example, the display-driving circuit 320 may initiate storage of the frame data 517 in the activated internal memory 322 at time 518.

According to various embodiments, the display-driving circuit 320 may display the first content 410 through the display panel 330 on the basis of the frame data 517 stored in the internal memory 322. For example, the display-driving circuit 320 may display the first content 410 in place of the second content 415 through the display panel 330 at time 519 on the basis of the frame data 517 stored in the internal memory 322. The time 519 at which the second content 415 is displayed may be identified on the basis of the time at which the vertical synchronization signal is acquired.

As described above, by delaying the time at which the frame data provided from the first processor 310 to the display-driving circuit 320 is stored in the internal memory 322 to the time at which generation of the frame data is completed by the first processor 310, the electronic device 300 according to various embodiments may prevent display of a screen through the display panel 330 on the basis of frame data that has not been completely generated.

Alternatively, the display-driving circuit 320 of the electronic device 300 may prevent display of the screen through the display panel 330 on the basis of the frame data that has not been completely generated by limiting transmission of the synchronization signal to the first processor 310. According to various embodiments, the first processor 310 may detect an event for changing the first content to the second content while the first content is displayed through the display panel 330. According to various embodiments, the first processor 310 may transmit information indicating the predetermined time, corresponding to the time required to acquire the second content, to the display-driving circuit 320 on the basis of the detection. According to various embodiments, the first processor 310 may initiate acquisition of the second content on the basis of the detection. Meanwhile, according to various embodiments, the display-driving circuit 320 may limit transmission of the synchronization signal to the first processor 310 for the predetermined time indicated by the information on the basis of reception of the information. For example, the display-driving circuit 320 may configure the counter value or the predetermined value as the value corresponding to the predetermined time on the basis of reception of the information. The display-driving circuit 320 may change the counter value in every frame and identify whether the changed counter value reaches the predetermined value. The display-driving circuit 320 may initiate or resume transmission of the synchronization signal to the first processor 310 in response to identification that the changed counter value has reached the predetermined value. The first processor 310 may receive the synchronization signal from the display-driving circuit 320.

According to various embodiments, since transmission of the synchronization signal to the first processor 310 is limited for the predetermined time, the first processor 310 may receive the synchronization signal after acquiring frame data including the second content. The first processor 310 may transmit the frame data including all of the second content to the display-driving circuit 320.

According to various embodiments, the display-driving circuit 320 may record or store the frame data including all of the second content in the internal memory 322 included in the display-driving circuit 320. The display-driving circuit 320 may display all of the second content through the display panel 330 on the basis of the stored frame data.

Figure 6:
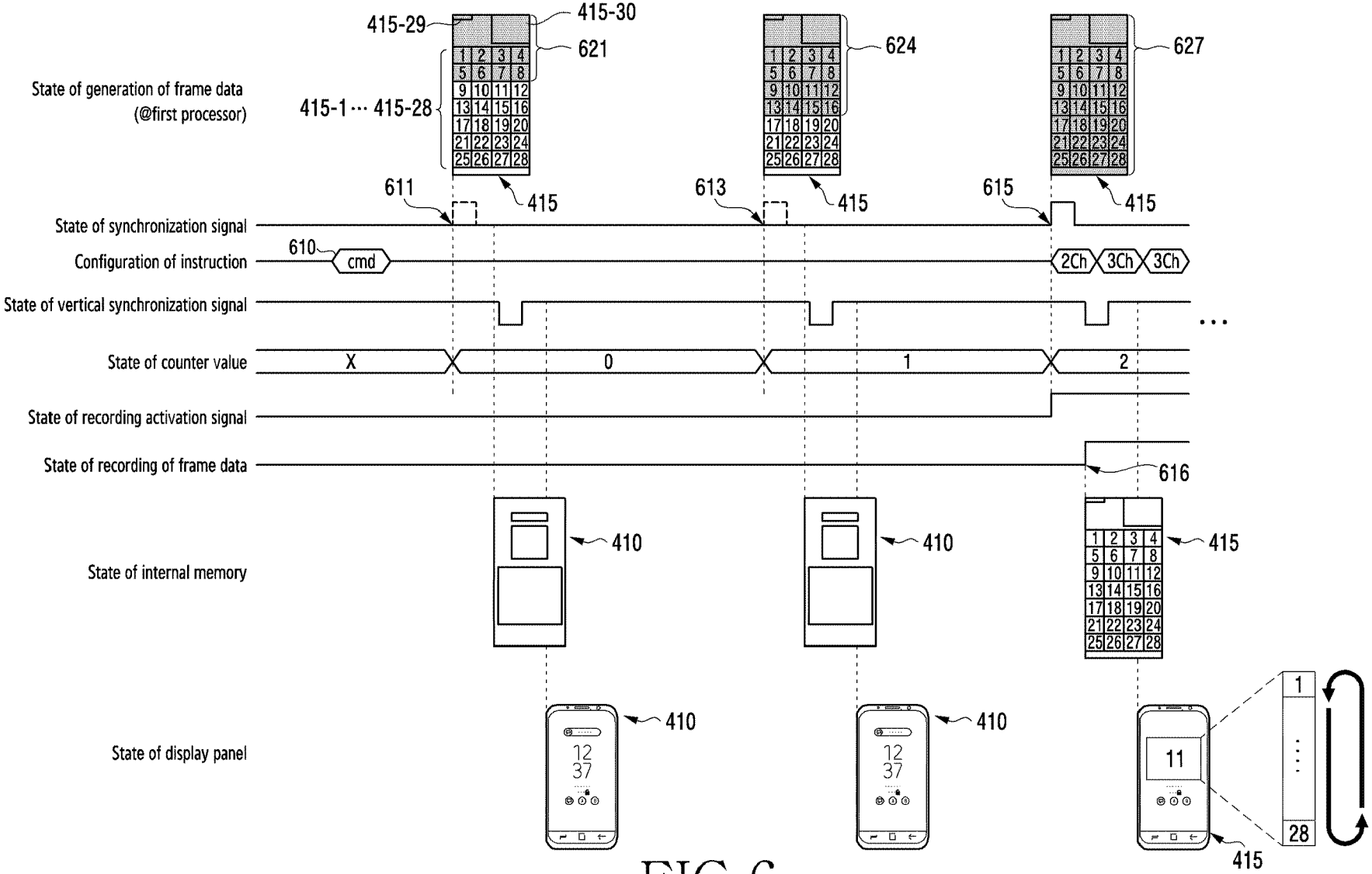
FIG. 6 illustrates another example of signaling between the first processor and the display-driving circuit within the electronic device according to various embodiments.

For example, referring to FIG. 6, the display-driving circuit 320 may display the first content 410 through the display panel 330.

According to various embodiments, the first processor 310 may detect an event for changing the first content 410 to the second content 415 while the first content 410 is being displayed. The first processor 310 may transmit information 610 to the display-driving circuit 320 on the basis of the detection. According to various embodiments, the information 610 may include data indicating that the display-driving circuit 320 limits transmission of the synchronization signal to the first processor 310 for the predetermined time. In the example of FIG. 6, the predetermined time may correspond to 2 frames (that is, ⅓ (=2/60) seconds). The display-driving circuit 320 may receive the information 610 from the first processor 310.

According to various embodiments, the display-driving circuit 320 may activate a counter value for monitoring whether the predetermined time elapses on the basis of reception of the information 610. According to various embodiments, the display-driving circuit 320 may configure a predetermined value for monitoring whether the predetermined time elapses on the basis of reception of the information 610. In the example of FIG. 6, the predetermined value may be configured as 2, corresponding to the predetermined time (for example, 2 frames).

According to various embodiments, the first processor 310 may generate the frame data including the second content 415 on the basis of the detection.

Meanwhile, the display-driving circuit 320 may identify whether to limit transmission of the synchronization signal to the first processor 310 while the frame data including the second content 415 is being generated.

For example, the display-driving circuit 320 may limit transmission of the synchronization signal to the first processor 310 at time 611, at which a frame subsequent to the frame for receiving the information 610 is initiated. The display-driving circuit 320 may limit transmission of the synchronization signal to the first processor 310 by changing the state of the synchronization signal to a null state at the time 611. The display-driving circuit 320 may limit transmission of the synchronization signal to the first processor 310 by masking the synchronization signal at the time 611. The display-driving circuit 320 may change the counter value from x to 0 at the time 611. The change in the counter value may be identified on the basis of masking of the synchronization signal. The display-driving circuit 320 may limit transmission of the synchronization signal to the first processor 310 on the basis of identification that the counter value (0) has not reached the predetermined value (2) at the time 611. Meanwhile, the first processor 310 may be in a state in which frame data including the part 612 of the second content is generated at the time 611. According to various embodiments, since the first processor 310 does not receive the synchronization signal, the first processor 310 may not transmit the frame data including the part 612 of the second content to the display-driving circuit 320. Meanwhile, the internal memory 322 included in the display-driving circuit 320 may maintain storage of the frame data including the first content 410 due to limit of transmission of the synchronization signal. Because the display-driving circuit 320 has not received the frame data including the part 612 of the second content, the display-driving circuit 320 may maintain the display of the first content 410 through the display panel 330. In other words, the display-driving circuit 320 may display the first content 410 on the basis of the frame data stored in the internal memory 322. The time at which the first content 410 is displayed may be identified on the basis of the time at which the vertical synchronization signal is acquired.

The display-driving circuit 320 may limit transmission of the synchronization signal to the first processor 310 at time 613 after one frame from the time 611. The display-driving circuit 320 may change the counter value from 0 to 1 at the time 613. The change in the counter value may be identified on the basis of masking of the synchronization signal. The display-driving circuit 320 may limit transmission of the synchronization signal to the first processor 310 on the basis of identification that the counter value (1) has not reached the predetermined value (2) at the time 613. Meanwhile, the first processor 310 may be in a state in which frame data including the part 614 of the second content 614 is generated at the time 613. According to various embodiments, since the first processor 310 does not receive the synchronization signal, the first processor 310 may not transmit the frame data including the part 614 of the second content to the display-driving circuit 320. Meanwhile, the internal memory 322 included in the display-driving circuit 320 may maintain storage of the frame data including the first content 410 due to limit of transmission of the synchronization signal. Since the display-driving circuit 320 has not received the frame data including the part 614 of the second content, the display-driving circuit 320 may maintain the display of the first content 410 through the display panel 330. In other words, the display-driving circuit 320 may display the first content 410 on the basis of the frame data stored in the internal memory 322. The time at which the first content 410 is displayed may be identified on the basis of the time at which the vertical synchronization signal is acquired.

The display-driving circuit 320 may transmit the synchronization signal to the first processor 310 at time 615 after one frame from the time 613. The display-driving circuit 320 may change the counter value from 1 to 2 at the time 615. The display-driving circuit 320 may transmit the synchronization signal to the first processor 310 on the basis of identification that the counter value (2) reaches the predetermined value (2) at the time 615. Meanwhile, the first processor 310 may be in a state in which the frame data including all of the second content 616 is generated at the time 615. According to various embodiments, the first processor 310 may transmit the frame data including all of the second content 616 to the display-driving circuit 320 in response to reception of the synchronization signal at the time 615. The display-driving circuit 320 may receive the frame data including all of the second content 616 from the first processor 310.

According to various embodiments, the display-driving circuit 320 may store the frame data including all of the second content 616 in the internal memory 322 at time 616, and may display at least the portion of the second content through the display panel 330 on the basis of the stored frame data. The time at which at least the portion of the second content is displayed may be identified on the basis of the time at which the vertical synchronization signal is acquired. According to various embodiments, since the display-driving circuit 320 sequentially scans the plurality of objects (objects 415-1 to 415-28) to provide the animation, at least the portion of the second content 415 displayed through the display panel 330 may include one object (for example, the object 415-11) among the plurality of objects (objects 415-1 to 415-28).

As described above, the electronic device 300 according to various embodiments may prevent the screen from being displayed through the display panel 330 on the basis of frame data that has not been completely generated by controlling the time of transmission of the synchronization signal transmitted from the display-driving circuit 320 to the first processor 310.

Alternatively, the first processor 310 of the electronic device 300 according to various embodiments may identify the predetermined time required to acquire the second content on the basis of detection of an event for changing the first content displayed through the display panel 330 to the second content. The first processor 310 may determine or identify transmission of the frame data including all of the first content that has been previously generated instead of the frame data including at least the portion of the second content to the display-driving circuit 320 for the predetermined time on the basis of identification that the predetermined time is longer than the amount of time corresponding to one frame. According to various embodiments, in order to transmit the frame data including all of the first content, the memory included in the electronic device 300 and operatively coupled to the first processor 310 may store the frame data including all of the first content.

According to various embodiments, the first processor 310 may transmit the frame data including all of the first content to the display-driving circuit 320 for the predetermined time in response to reception of the synchronization signal from the display-driving circuit 320 in every frame on the basis of the identification. The display-driving circuit 320 may store the frame data including all of the first content in the internal memory 322 and maintain the display of all of the first content on the basis of the stored frame data.

According to various embodiments, the first processor 310 may transmit the frame data including all of the second content to the display-driving circuit 320 on the basis of identification that the predetermined time has elapsed. The display-driving circuit 320 may store the frame data including all of the second content in the internal memory 322 and display the second content in place of the first content on the basis of the stored frame data.

As described above, the first processor 310 of the electronic device 300 according to various embodiments may store second frame data related to the screen currently displayed on the display panel 330, rather than first frame, which is being generated while the first frame data is being generated, and transmit the second frame data to the display-driving circuit 320, thus preventing the screen from being displayed on the basis of the first frame data that has not been completely generated.

FIGS. 4 to 6 illustrate examples in which the display panel 330 of the electronic device 300 changes content displayed in the AOD mode from the first content 410 including at least one image (or at least one visual object) distinguished from the animation to the second content 415 including at least one image (or at least one visual object) for providing animation or examples in which the display panel 330 changes the content from the second content 415 including at least one image for providing animation to the first content 410 including at least one image distinguished from the animation, but illustration thereof is only for convenience of description. According to embodiments, at least one of the first content 410 and the second content 415 may be replaced with content having different characteristics. For example, the first content 410 may be replaced with a screen indicating that the electronic device 300 is currently being booted, and the second content 415 may be replaced with wallpaper that is subsequent to the screen indicating that the electronic device 300 is currently being booted and is displayed through synthesis of multiple layers. In another example, the first content 410 may be replaced with wallpaper displayed after booting of the electronic device 300, and the second content 415 may be replaced with a screen that is subsequent to the wallpaper and includes a plurality of objects for executing a plurality of applications stored in the electronic device (that is, a list of the plurality of applications). In this case, switching from the first content 410 to the second content 415 may be performed on the basis of user input (for example, touch input on a shortcut icon displayed on top of the wallpaper) received while the wallpaper is displayed. In another example, the first content 410 may be replaced with a screen including at least one icon for executing at least one application, and the second content 415 may be replaced with an execution screen of an application (for example, a screen listing photos in a gallery application) indicated by one icon identified by a user input among the at least one icon. However, this is not limiting.

An electronic device (for example, the electronic device 300) according to various embodiments as described above may include a display panel (for example, the display panel 330), a processor (for example, the first processor 310), and a display-driving circuit (for example, the display-driving circuit 320) including a memory (for example, the internal memory 322) and configured to drive the display panel, wherein the display-driving circuit is configured to receive first frame data including at least a portion of second content from the processor while first content is being displayed through the display panel, prevent storage of the received first frame data in the memory at least temporarily for a predetermined time, receive second frame data including at least the portion of the second content from the processor after the predetermined time, store the received second frame data in the memory, and display the second content through the display panel according to the second frame data.

According to various embodiments, the display-driving circuit may be configured to receive information related to the predetermined time from the processor and receive the first frame data from the processor after receiving the information.

According to various embodiments, the display-driving circuit may be configured to prevent storage of the first frame data in the memory by discarding the first frame data received from the processor at least temporarily for the predetermined time.

According to various embodiments, the memory may be disposed within the display-driving circuit.

According to various embodiments, the electronic device may operate in a low-power state, the processor in the low-power state may be configured to limit transmission of image data to the display-driving circuit when the processor is in a sleep state, and the display-driving circuit is configured to display the first content on the basis of the image data stored in the memory. For example, at least the portion of the first content may be configured as an image including a plurality of objects, and the second content may be configured as another image distinguished from the image including the plurality of objects.

According to various embodiments, the processor may be further configured to transmit the first frame data including information on a portion of the second content to the display-driving circuit in response to reception of a synchronization signal indicating the time at which data is recorded in the memory and transmit the second frame data including all of the content to the display-driving circuit in response to reception of the synchronization signal from the display-driving circuit after the predetermined time.

According to various embodiments, the processor may be configured to identify that synthesis of multiple layers is required in order to generate the second content, transmit information indicating the predetermined time to the display-driving circuit on the basis of the identification, generate the first frame data by synthesizing a portion of the multiple layers, transmit the first frame data to the display-driving circuit in response to reception of a synchronization signal indicating the time at which data is recorded in the memory from the display-driving circuit, identify completion of the synthesis of the multiple layers, and transmit the second frame data, obtained by synthesizing all of the multiple layers, to the display-driving circuit in response to reception of the synchronization signal from the display-driving circuit after the predetermined time.

According to various embodiments, the predetermined time may correspond to at least one frame.

According to various embodiments, the processor may be configured to identify the number of a plurality of objects included in the second content, identify the predetermined time on the basis of the number of the plurality of objects, and transmit information indicating the predetermined time to the display-driving circuit.

An electronic device (for example, the electronic device 300) according to various embodiments as described above may include a display panel (for example, the display panel 330), a display-driving circuit (for example, the display-driving circuit 320) including a memory (for example, the internal memory 322) and operatively coupled to the display panel, and a processor (for example, the first processor 310) operatively coupled to the display-driving circuit, wherein the display-driving circuit is configured to display first content, receive a command indicating a delay time from the processor, discard first frame data on second content received from the processor for the delay time starting from a predetermined time by delaying activation of the memory for the delay time starting from the predetermined time, generate a signal for activating the memory after the delay time from the predetermined time, store second frame data on the second content received from the processor after the delay time from the predetermined time in the memory activated on the basis of the signal, and display the second content changed from the first content on the basis of the stored second frame data.

According to various embodiments, the display-driving circuit may be further configured to display the first content while the first frame data is discarded.

According to various embodiments, the memory may be configured to store third frame data on the first content while the first frame data is discarded.

According to various embodiments, each of the first frame data and the second frame data may include at least one of an instruction of 2Ch of a Mobile Industry Processor Interface (MIPI) standard or an instruction of 3Ch of the MIPI standard, and the command may include an instruction different from the instruction of 2Ch and the instruction of 3Ch, among instructions from 00h to FFh of the MIPI standard.

According to various embodiments, the display-driving circuit may be configured to configure a counter value on the basis of the delay time indicated by the command, identify a designated command from the first frame data received from the processor, change the counter value on the basis of the identification, and identify that the delay time has elapsed since the predetermined time by identifying that the changed counter value reaches a predetermined value. According to various embodiments, the size of the second content included in the first frame data may be smaller than the size of the second content included in the second frame data.

According to various embodiments, the predetermined time may be related to the time at which a synchronization signal indicating the time at which data is recorded in the memory is transmitted from the display-driving circuit to the processor.

An electronic device (for example, the electronic device 300) according to various embodiments as described above may include a display panel (for example, the display panel 330), a display-driving circuit (for example, the display-driving circuit 320) including a memory (for example, the internal memory 322) and operatively coupled to the display panel, and a processor (for example, the first processor 310) operatively coupled to the display-driving circuit, wherein the display-driving circuit is configured to store first frame data in the memory after a first time elapses from the time at which the first frame data related to first content is initially received from the processor and store second frame data in the memory after a second time different from the first time elapses from the time at which the second frame data related to second content different from the first content is initially received from the processor.

According to various embodiments, the configuration of the second content may be different from the configuration of the first content.

According to various embodiments, a load on the processor at a time at which the first frame data is acquired may be different from a load on the processor at a time at which the second frame data is acquired.

Figure 7:
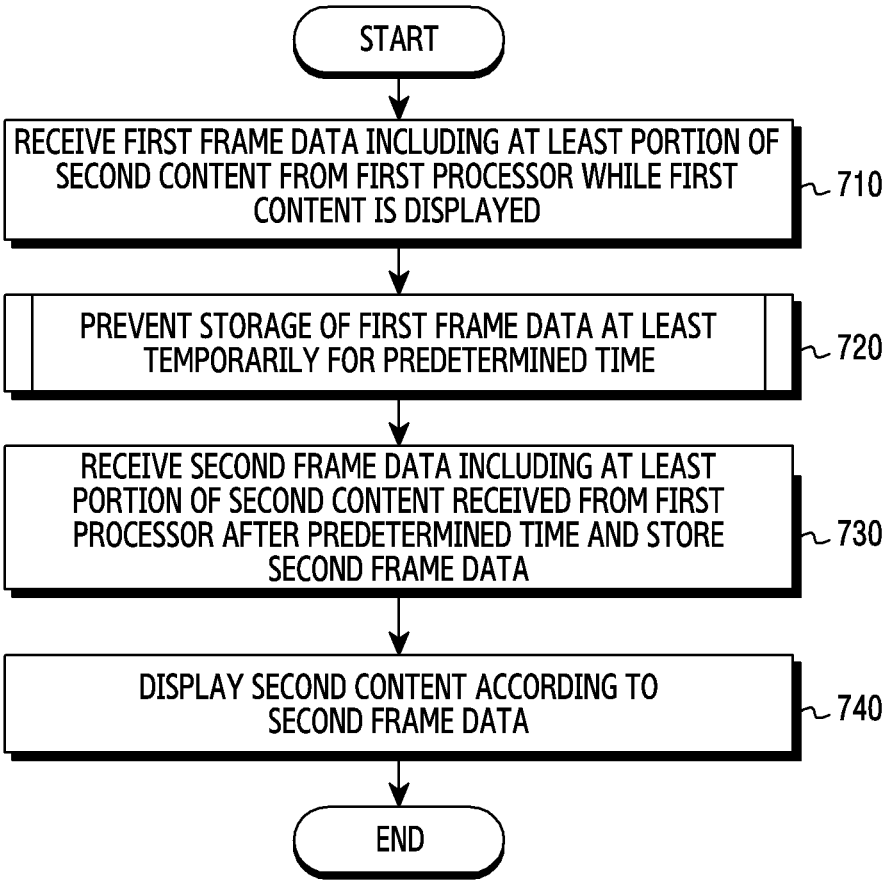
FIG. 7 illustrates an example of the operation of an electronic device according to various embodiments.

FIG. 7 illustrates an example of the operation of the electronic device according to various embodiments. The operation may be performed by the electronic device 101 illustrated in FIG. 1, the electronic device 300 illustrated in FIG. 3, the display driver IC 230 illustrated in FIG. 2, or the display-driving circuit 320 illustrated in FIG. 3.

Referring to FIG. 7, the display-driving circuit 320 may receive first frame data including at least the portion of the second content from the first processor 310 while the first content is displayed in operation 710. According to various embodiments, since the display-driving circuit 320 displays the first content through the display panel 330, the internal memory 322 in the display-driving circuit 320 may store frame data including the first content. According to various embodiments, the first processor 310 may determine to generate the frame data including the second content on the basis of detection of an event for changing the content displayed through the display panel 330 from the first content to the second content, and may perform at least one operation for generating the frame data including the second content on the basis of the determination. For example, the first processor 310 may generate the frame data including the second content on the basis of the detection while the first content is being displayed through the display panel 330. The first processor 310 may receive the synchronization signal from the display-driving circuit 320 while the second content is being generated. According to various embodiments, the synchronization signal may be transmitted from the display-driving circuit 320 to the first processor 310. The synchronization signal may be a signal making a request for transmitting frame data to be recorded in the internal memory 322 by the first processor 310. The first processor 310 may transmit the first frame data including at least the portion of the second content generated by the time point at which the synchronization signal is received to the display-driving circuit 320. The display-driving circuit 320 may receive the first frame data including at least the portion of the second content generated by the time point at which the synchronization signal is received from the first processor 310.

In operation 720, the display-driving circuit 320 may prevent storage of the first frame data at least temporarily for a predetermined time. According to various embodiments, before receiving the first frame data, the display-driving circuit 320 may receive information making a request for preventing storage of the frame data received for the predetermined time starting at a predetermined time point from the first processor 310. The predetermined time point may be associated with the time at which the synchronization signal is transmitted from the display-driving circuit 320 to the first processor 310. The information may include data indicating the predetermined time. According to various embodiments, the display-driving circuit 320 may identify the predetermined time on the basis of the information received from the first processor 310 and prevent storage of the first frame data received from the first processor 310 on the basis of the identified predetermined time. For example, the display-driving circuit 320 may prevent storage of the first frame data in the internal memory 322 by discarding the first frame data received from the first processor 310 on the basis of the information. According to various embodiments, the display-driving circuit 320 may maintain the display of the first content through the display panel 330 while preventing storage of the first frame data.

In operation 730, the display-driving circuit 320 may receive and store second frame data including at least the portion of the second content from the first processor 310 after the predetermined time. According to various embodiments, the display-driving circuit 320 may prevent storage of the frame data transmitted from the first processor 310 in every frame for the delay time starting from the predetermined time after receiving the information, and may receive and store the second frame data including at least the portion of the second content on the basis of identification that the predetermined time has elapsed since the predetermined time. According to various embodiments, the size of at least the portion of the second content included in the second frame data may be larger than the size of at least a portion of the first content included in the first frame data. This is because the time from the time point at which the event is detected to the time point at which the second frame data is transmitted is longer than the time from the time point at which the event is detected to the time point at which the first frame data is transmitted. For example, while the first frame data may include some of the second content, the second frame data may include all of the second content.

In operation 740, the display-driving circuit 320 may display the second content according to the second frame data. According to various embodiments, the display-driving circuit 320 may display the second content on the basis of a frame update through storage of the second frame data. According to various embodiments, since the second frame data may include all of the second content, the display-driving circuit 320 may display at least the portion of the second content through the display panel 330 on the basis of the stored second frame data. According to various embodiments, since the display-driving circuit 320 sequentially scans a plurality of objects to provide the animation, at least the portion of the second content displayed through the display panel 330 may include one of the plurality of objects.

As described above, the electronic device 300 according to various embodiments may prevent the frame update in the memory associated with the display-driving circuit 320 until the first processor 310 completes generation of the frame data by preventing the display-driving circuit 320 from storing the frame data received from the first processor 310 for the predetermined time. Through prevention of the update, the electronic device 300 according to various embodiments may prevent content that should be concurrently displayed from being sequentially displayed.

Figure 8:
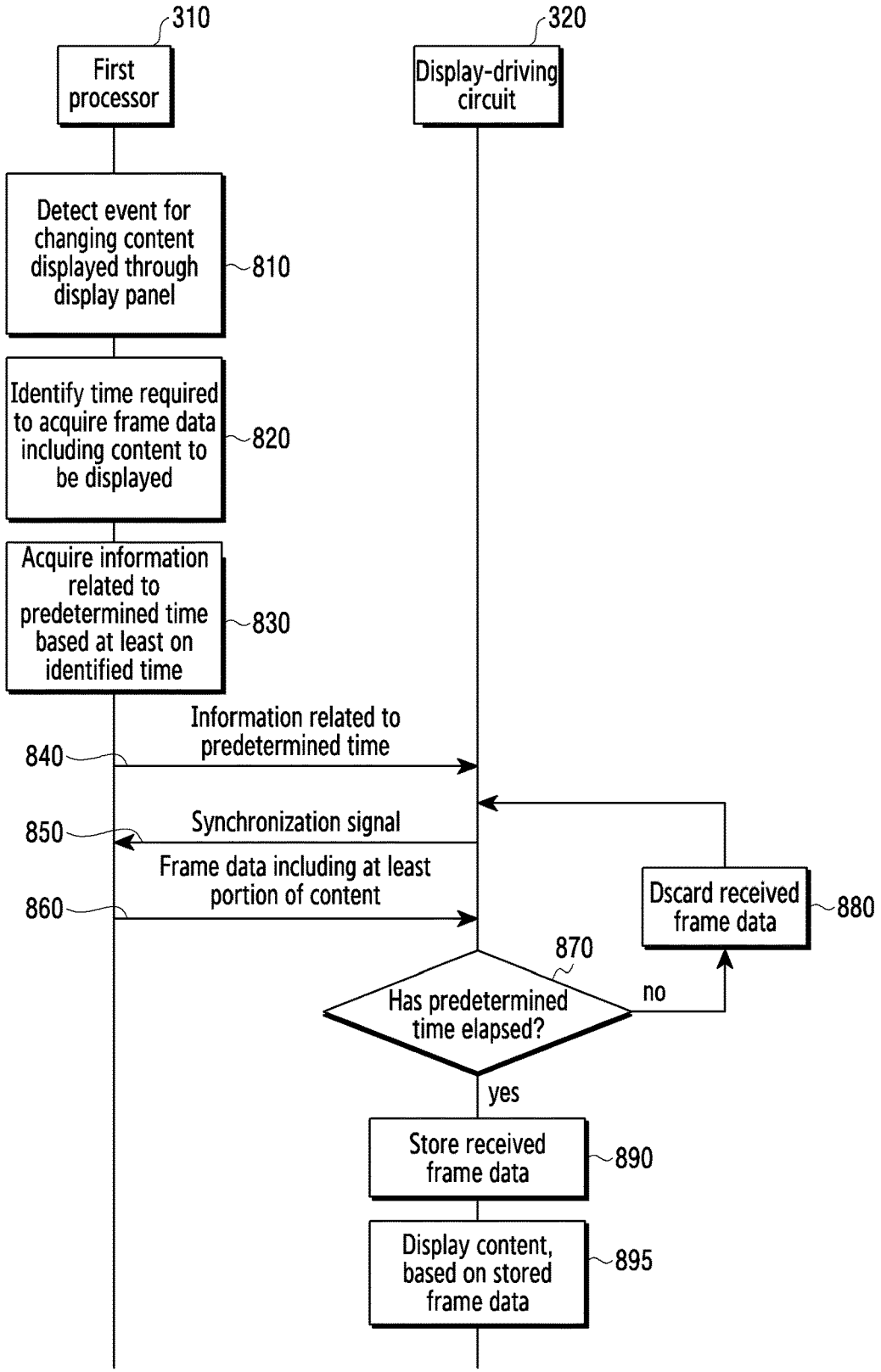
FIG. 8 illustrates another example of the operation of an electronic device according to various embodiments.

FIG. 8 illustrates another example of the operation of the electronic device according to various embodiments. The operation may be performed by the electronic device 101 illustrated in FIG. 1 or the electronic device 300 illustrated in FIG. 3.

Referring to FIG. 8, in operation 810, the first processor 310 may detect an event for changing content displayed through the display panel 330. For example, the event may be reception of user input making a request for a screen change. In another example, the event may be a screen change independent from the user input (for example, a change from an AOD non-self-animation mode to an AOD self-animation mode) according to a scenario designated by an application or a program. Meanwhile, the display-driving circuit 320 may display the content through the display panel 330 while the first processor 310 detects the event.

In operation 820, the first processor 310 may identify the time required to acquire frame data including content to be displayed (or changed) on the basis of the detection. For example, the first processor 310 may identify the time required to completely acquire frame data including the content to be displayed on the basis of the current load on the first processor 310. In another example, the first processor 310 may identify the time required to completely acquire frame data including the content on the basis of the configuration of the content to be displayed. In another example, the first processor 310 may identify the time required to completely acquire frame data including the content on the basis of the size of the content to be displayed. In another example, the first processor 310 may identify the time required to completely acquire frame data including the content on the basis of the number of objects included in the content to be displayed. In another example, the first processor 310 may identify the time required to completely acquire frame data including the content on the basis of a type (or characteristic) of the service provided by the content to be displayed. In another example, the first processor 310 may identify the time required to completely acquire frame data including the content on the basis of the type of a scheme for generating the content to be displayed. In another example, the first processor 310 may identify the time required to completely acquire frame data including the content on the basis of the power state of a battery of the electronic device 300. However, this is not limiting.

In operation 830, the first processor 310 may acquire information related to the predetermined time on the basis of at least the identified time. According to various embodiments, the first processor 310 may identify the number of frames corresponding to the identified time, and may configure the time corresponding to the identified number of frames, so as to acquire information related to the predetermined time. According to various embodiments, the first processor 310 may acquire information related to the predetermined time on the basis of at least the identified time, time resources used by the first processor 310, and time resources used by the display-driving circuit 320.

In operation 840, the first processor 310 may transmit the information related to the predetermined time to the display-driving circuit 320. When the information related to the predetermined time is transmitted through an MIPI, the information related to the predetermined time may include another instruction different from the instruction of 2Ch and the instruction of 3Ch, among instructions from 00h to FFh. According to various embodiments, another instruction may correspond to a reserved instruction. The display-driving circuit 320 may receive the information related to the predetermined time from the first processor 310.

In operation 850, the display-driving circuit 320 may transmit the synchronization signal to the first processor 310 in every frame. According to various embodiments, the synchronization signal may be transmitted to the first processor 310 in every frame on the basis of a clock configured in the display-driving circuit 320. The first processor 310 may receive the synchronization signal from the display-driving circuit 320.

In operation 860, the first processor 310 may transmit frame data including at least the portion of the content acquired until the synchronization signal is received to the display-driving circuit 320 in response to reception of the synchronization signal. For example, referring to FIG. 9, the first processor 310 may acquire frame data 910 including the portion 907 of the entire content 905 until the synchronization signal is received. The first processor 310 may transmit the frame data 910 acquired until the synchronization signal is received to the display-driving circuit 320 in response to reception of the synchronization signal. The display-driving circuit 320 may receive the frame data 910.

FIG. 8 illustrates an example of transmitting the frame data in operation 860 after transmitting the information related to the predetermined time in operation 840, but this example is only for convenience of description. For example, the information related to the predetermined time may be transmitted from the first processor 310 to the display-driving circuit 320 in response to reception of the synchronization signal from the display-driving circuit 320. In another example, the information related to the predetermined time may be transmitted from the first processor 310 immediately before or after the frame data is transmitted. In another example, the information related to the predetermined time may be transmitted from the first processor 310 along with the frame data. However, this is not limiting.

In operation 870, after receiving the information related to the predetermined time, the display-driving circuit 320 may monitor whether the predetermined time has elapsed. In order to identify whether to store or discard the frame data received from the first processor 310, the display-driving circuit 320 may monitor whether the predetermined time has elapsed. When it is monitored that the predetermined time has elapsed, the display-driving circuit 320 may perform operation 890. However, when it is monitored that the predetermined time has not elapsed, the display-driving circuit 320 may perform operation 880.

In operation 880, the display-driving circuit 320 may discard the received frame data upon monitoring that the predetermined time has not elapsed. After discarding the received frame data, the display-driving circuit 320 and the first processor 310 may repeatedly perform operations 850 to 870 until it is monitored that the predetermined time has elapsed.

In operation 890, the display-driving circuit 320 may store the received frame data upon monitoring that the predetermined time has elapsed. Monitoring that the predetermined time has elapsed may mean that the frame data is completely acquired by the first processor 310, and thus the display-driving circuit 320 may store the received frame data.

In operation 895, the display-driving circuit 320 may display the content through the display panel 330 on the basis of the stored frame data.

Figure 9:
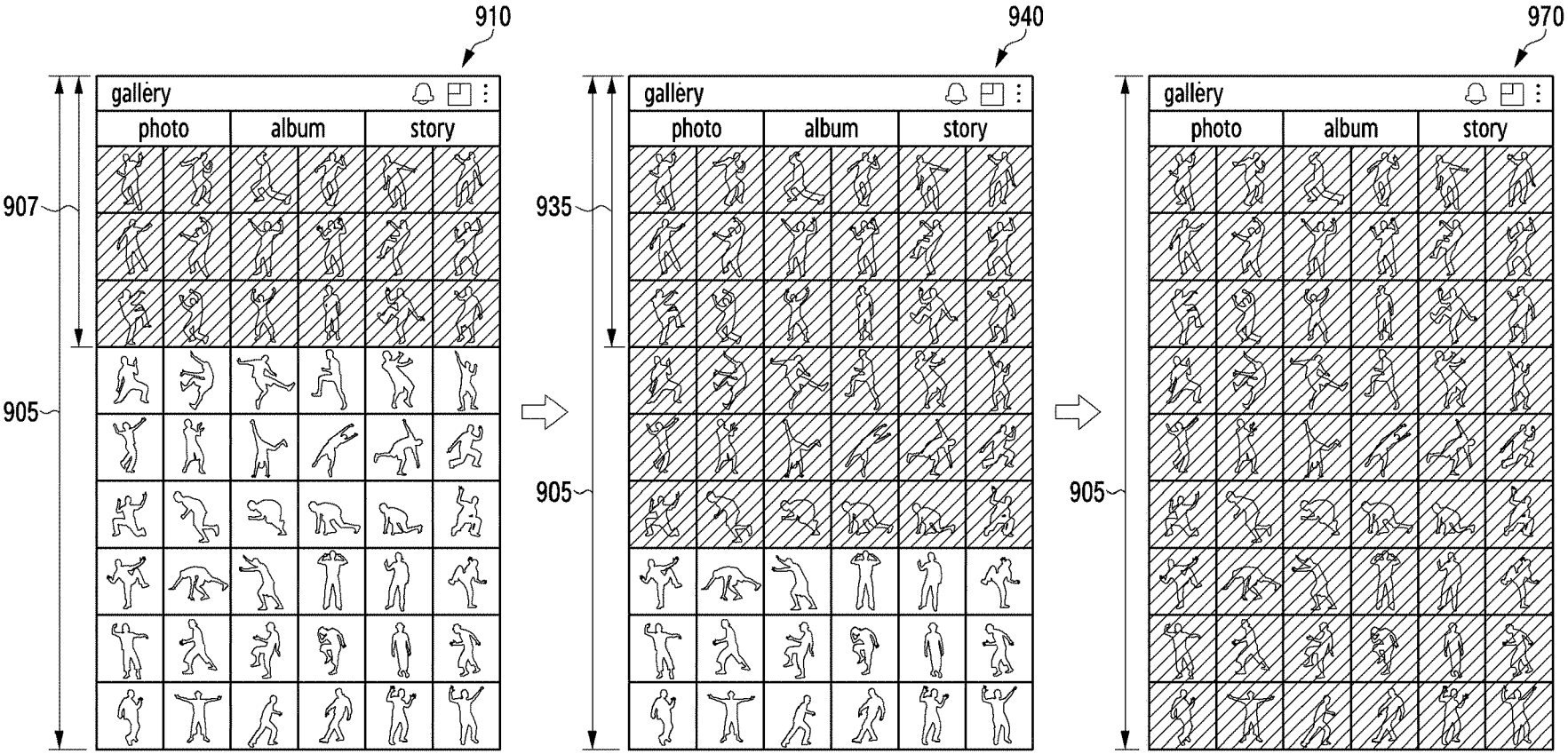
FIG. 9 illustrates an example of a state of frame data related to an electronic device according to various embodiments.

For example, referring to FIG. 9, the display-driving circuit 320 may discard the frame data 910 received from the first processor 310 upon monitoring that the predetermined time has not elapsed. Monitoring that the predetermined time has not elapsed may mean that the frame data 970 including the content has not been completely acquired by the first processor 310. According to various embodiments, the display-driving circuit 320 may discard the frame data 910 to prevent storage of the frame data 910 that has not been completely acquired in the internal memory 322.

When the frame data is discarded, the display-driving circuit 320 may provide the synchronization signal to the first processor 310. The first processor 310 may transmit frame data including at least the portion of the content acquired until the synchronization signal is received to the display-driving circuit 320 in response to reception of the synchronization signal. For example, the first processor 310 may acquire the frame data 940 including the portion 935 of the entire content 905 until the synchronization signal is received. The first processor 310 may transmit the frame data 940 acquired until the synchronization signal is received to the display-driving circuit 320 in response to reception of the synchronization signal. The display-driving circuit 320 may receive the frame data 940.

The display-driving circuit 320 receiving the frame data 940 may monitor whether the predetermined time has elapsed. The display-driving circuit 320 may discard the received frame data 940 upon monitoring that the predetermined time has not elapsed. Monitoring that the predetermined time has not elapsed may mean that the frame data 970 including the content has not been completely acquired by the first processor 310. According to various embodiments, the display-driving circuit 320 may discard the frame data 940 to prevent storage of the frame data 940 that has not been completely acquired in the internal memory 322.

When the frame data is discarded, the display-driving circuit 320 may provide the synchronization signal, transmitted in every frame, to the first processor 310. The first processor 310 may transmit frame data including at least the portion of the content acquired until the synchronization signal is received to the display-driving circuit 320 in response to reception of the synchronization signal. For example, referring to FIG. 9, the first processor 310 may acquire the frame data 970 including all of the content 905 until the synchronization signal is received. The first processor 310 may acquire the frame data 970 until the synchronization signal is received in response to reception of the synchronization signal. The first processor 310 may transmit the frame data 970 to the display-driving circuit 320 in response to reception of the synchronization signal. The display-driving circuit 320 may receive the frame data 970. The display-driving circuit 320 receiving the frame data 970 may store the frame data 970 upon monitoring that the predetermined time has elapsed. The display-driving circuit 320 may display all of the content 905 through the display panel 330 on the basis of the frame data 970.

Figure 10:
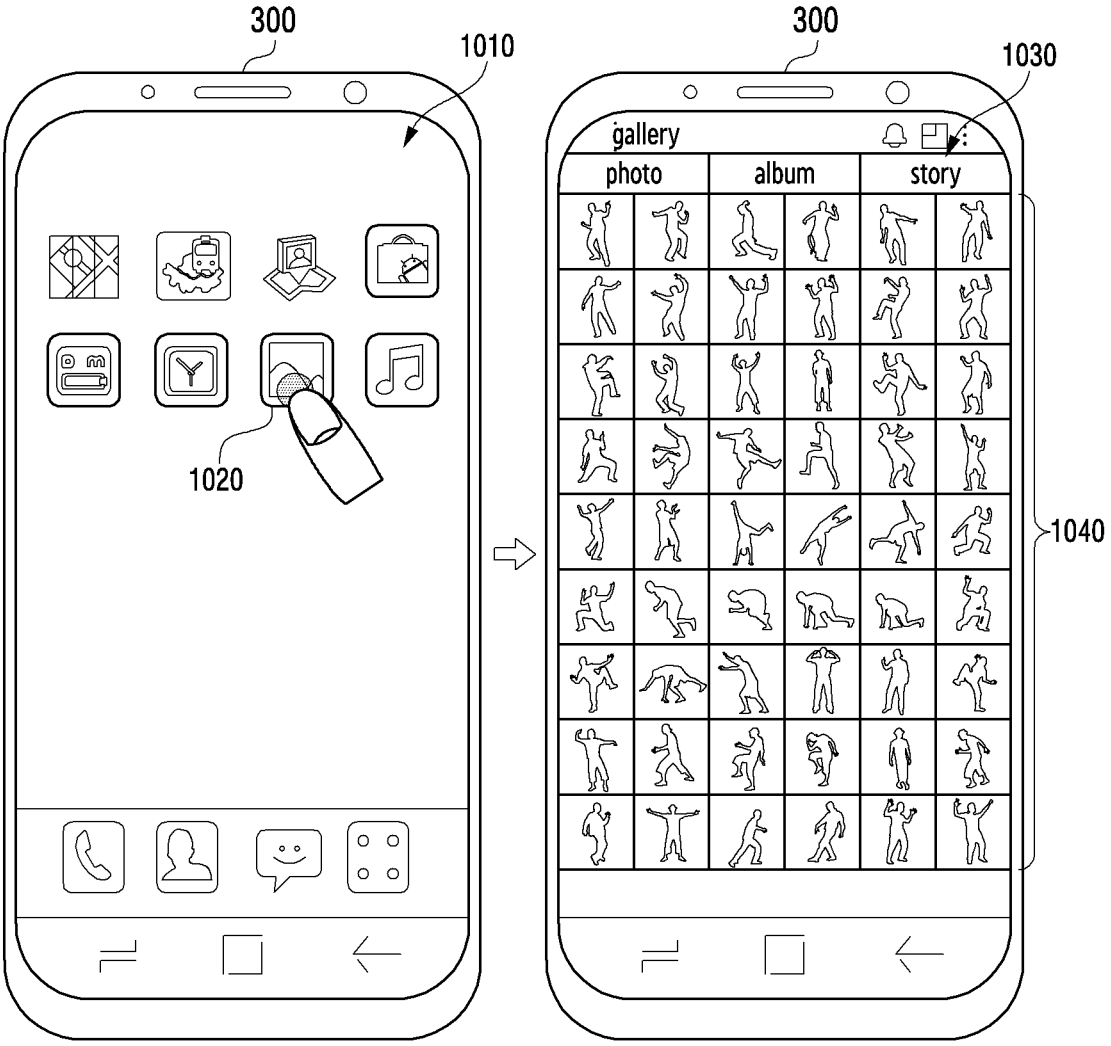
FIG. 10 illustrates an example in which an electronic device displays second content changed from first content according to various embodiments.

FIG. 10 illustrates an example in which the electronic device displays second content changed from first content according to various embodiments. The displaying may be performed by the electronic device 101 illustrated in FIG. 1 or the electronic device 300 illustrated in FIG. 3.

Referring to FIG. 10, the display-driving circuit 320 may display wallpaper 1010 through the display panel 330. The first processor 310 may detect a user input 1020 on an object to execute a gallery application among a plurality of object in the wallpaper 1010 while the wallpaper 1010 is being displayed. The first processor 310 may identify generation of a screen 1030 related to the gallery application on the basis of the detection. The screen 1030 may include may include a plurality of thumbnail images 1040 representing a plurality of images as visual objects to be included in the wallpaper 1030, as illustrated in FIG. 10. According to various embodiments, the first processor 310 may identify that the time required to acquire the screen 1030 is shorter than one frame, and may transmit information on a predetermined time corresponding to the time required to acquire the screen 1030 to the display-driving circuit 320 on the basis of the identification. The display-driving circuit 320 may identify discarding of frame data transmitted from the first processor 310 for the predetermined time from the time at which the synchronization signal is transmitted from the display-driving circuit 320 to the first processor 310 on the basis of reception of the information on the predetermined time. The display-driving circuit 320 may discard frame data related to the screen 1030 received from the first processor 310 for the predetermined time from the time at which the synchronization signal is transmitted from the display-driving circuit 320 to the first processor 310 on the basis of the identification. After the predetermined time elapses from the time at which the synchronization signal is transmitted from the display-driving circuit 320 to the first processor 310, the display-driving circuit 320 may store the frame data related to the screen 1030 received from the first processor 310. The display-driving circuit 320 may display the screen 1030 switched from the wallpaper 1010 on the basis of the stored frame data. Since the screen 1030 is displayed on the basis of the completely acquired frame data, the display-driving circuit 320 may concurrently display a plurality of visual objects (for example, a plurality of thumbnail images 1040) included in the screen 1030 even though the screen displayed through the display panel 330 switches from the wallpaper 1010 to the screen 1030.

Figure 11:
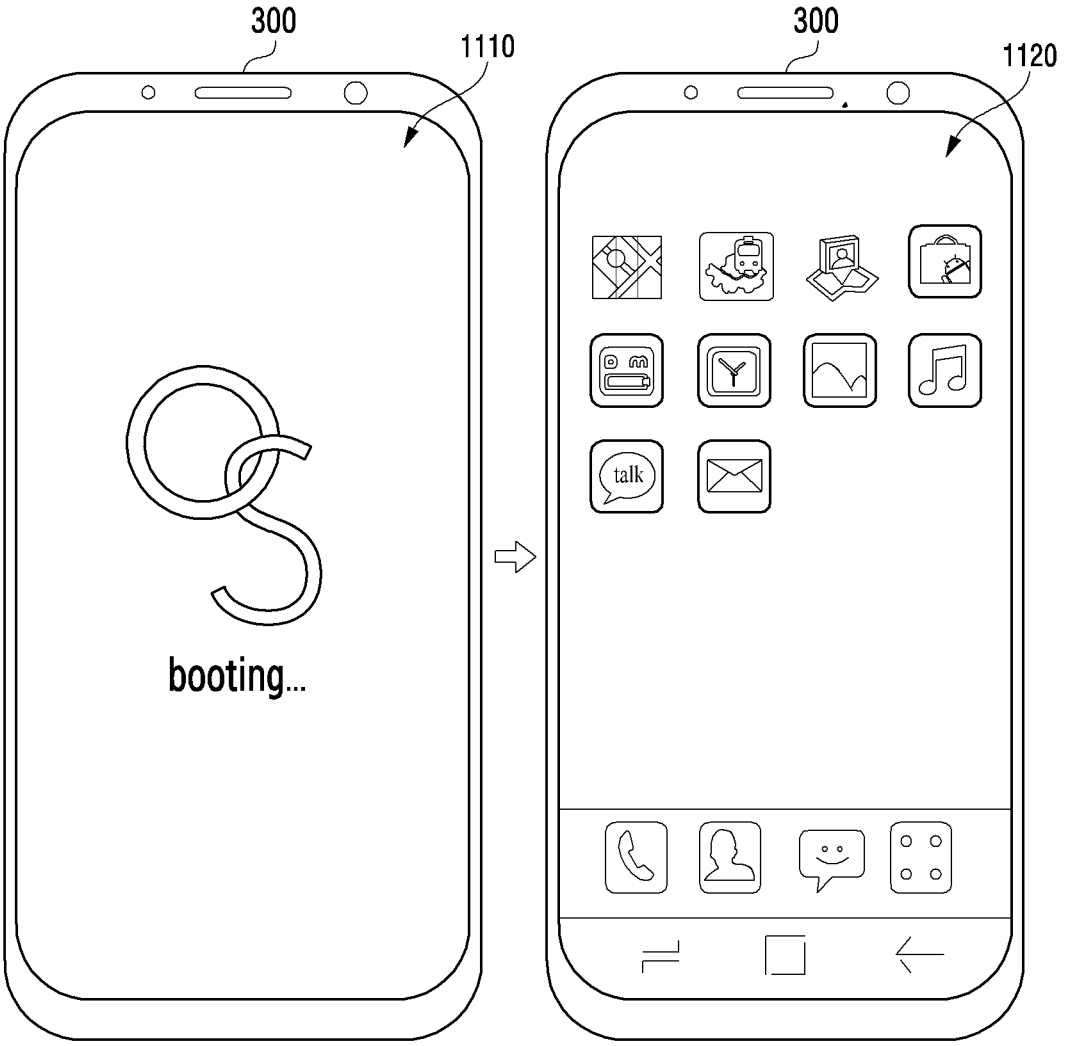
FIG. 11 illustrates another example in which the electronic device displays second content changed from first content according to various embodiments.

FIG. 11 illustrates another example in which the electronic device displays second content changed from first content according to various embodiments. The displaying may be performed by the electronic device 101 illustrated in FIG. 1 or the electronic device 300 illustrated in FIG. 3.

Referring to FIG. 11, the display-driving circuit 320 may display a screen 1110 indicating that the electronic device 300 is being booted while the electronic device 300 is being booted. The first processor 310 displaying the screen 1110 may complete booting of the electronic device 300 and generate a screen 1120 to be displayed after the screen 1110. The screen 1120 may be generated through synthesis of a plurality of layers, as illustrated in FIG. 11. According to various embodiments, the first processor 310 may identify that the time required to generate the screen 1120 is shorter than one frame and transmit information on a predetermined time, corresponding to the time required to acquire the screen 1120, to the display-driving circuit 320 on the basis of the identification. The display-driving circuit 320 may identify discarding of frame data transmitted from the first processor 310 for the predetermined time from the time at which the synchronization signal is transmitted from the display-driving circuit 320 to the first processor 310 on the basis of reception of the information on the predetermined time. The display-driving circuit 320 may discard frame data related to the screen 1120 received from the first processor 310 for the predetermined time from the time at which the synchronization signal is transmitted from the display-driving circuit 320 to the first processor 310 on the basis of the identification. After the predetermined time elapses from the time at which the synchronization signal is transmitted from the display-driving circuit 320 to the first processor 310, the display-driving circuit 320 may store the frame data related to the screen 1120 received from the first processor 310. The display-driving circuit 320 may display the screen 1120 switched from the screen 1110 on the basis of the stored frame data. Since the screen 1120 is displayed on the basis of the completely acquired frame data, the display-driving circuit 320 may concurrently display a plurality of visual objects included in the screen 1120 even though the screen displayed through the display panel 330 switches from the screen 1110 to the screen 1120.

Figure 12:
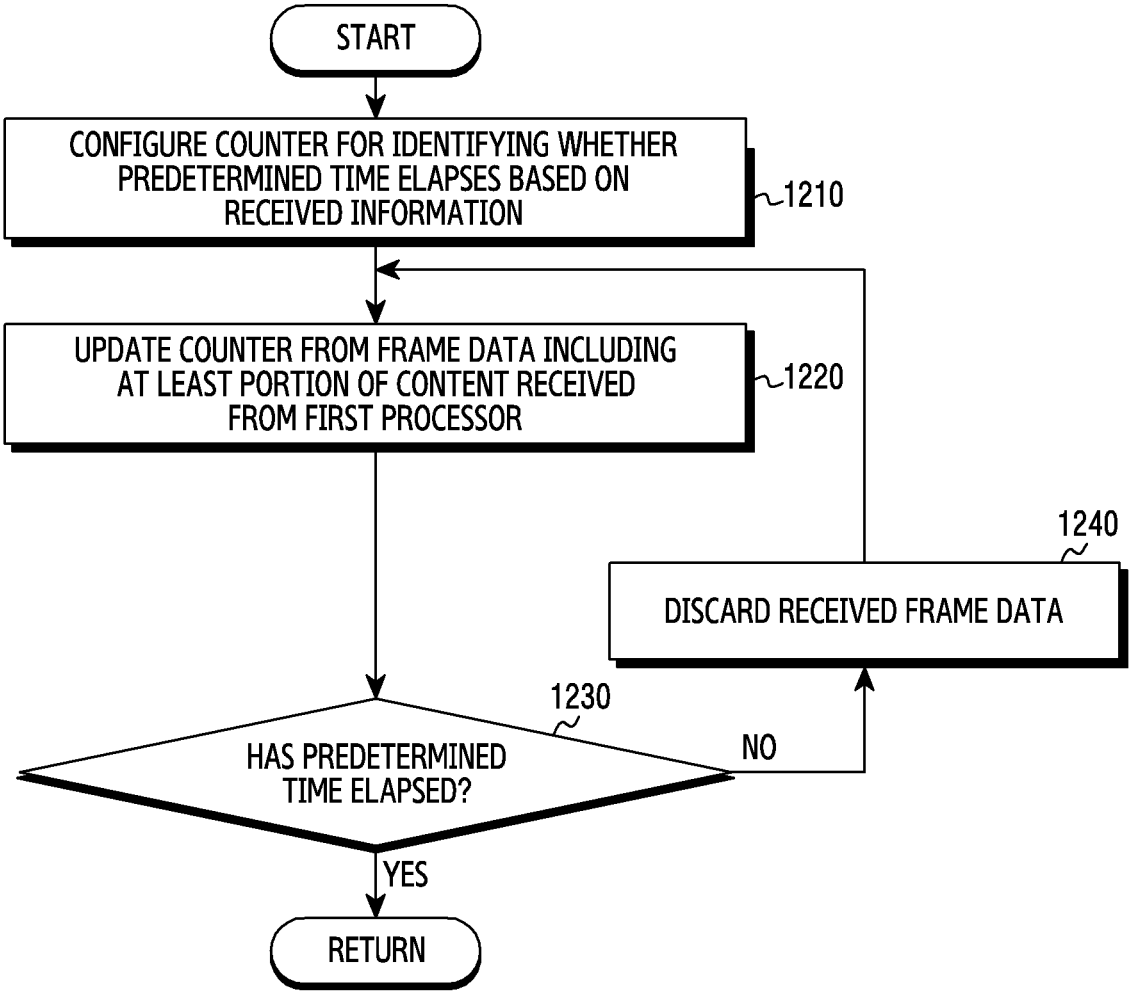
FIG. 12 illustrates an example of the operation of an electronic device for preventing storage of received frame data according to various embodiments.

FIG. 12 illustrates an example of the operation of the electronic device for preventing storage of received frame data according to various embodiments. The operation may be performed by the electronic device 101 illustrated in FIG. 1, the electronic device 300 illustrated in FIG. 3, the display driver IC 230 illustrated in FIG. 2, or the display-driving circuit 320 illustrated in FIG. 3.

Operations 1210 to 1240 of FIG. 12 may be associated with operation 720 of FIG. 7.

Referring to FIG. 12, in operation 1210, the display-driving circuit 320 may configure a counter for identifying whether a predetermined time has elapsed on the basis of information received from the first processor 310. According to various embodiments, the display-driving circuit 320 may configure at least one of a counter value related to the counter or a predetermined value related to the counter on the basis of the predetermined time indicated by the received information.

In operation 1220, the display-driving circuit 320 may update the counter on the basis of frame data including at least the portion of the content received from the first processor 310. After configuring the counter, the display-driving circuit 320 may receive, from the first processor 310, frame data including at least the portion of the content periodically transmitted on the basis of a synchronization signal from the display-driving circuit 320 to the first processor 310. The display-driving circuit 320 may identify a predetermined instruction (for example, the instruction of 2Ch of the MIPI standard) among instructions included in the received frame data and update the counter on the basis of the identification. The update of the counter may be performed to identify whether the predetermined time has elapsed.

In operation 1230, the display-driving circuit 320 may identify whether the predetermined time has elapsed on the basis of the update of the counter. For example, when the counter value after the update is 1 and the predetermined value 2, the display-driving circuit 320 may identify that the predetermined time has not elapsed. In another example, when the counter value after the update is 2 and the predetermined value is 2, the display-driving circuit 320 may identify that the predetermined time has elapsed. According to various embodiments, the display-driving circuit 320 may perform operation 1240 in response to identification that the predetermined time has not elapsed. According to various embodiments, the display-driving circuit 320 may perform operation 730 in response to identification that the predetermined time has elapsed.

In operation 1240, the display-driving circuit 320 may discard the received frame data on the basis of identification that the predetermined time has not elapsed.

As described above, the electronic device 300 may prevent content that has not completely generated from being displayed through the display panel 330 by discarding the frame data received from the first processor 310 in the state in which the predetermined time has not elapsed.

Figure 13:
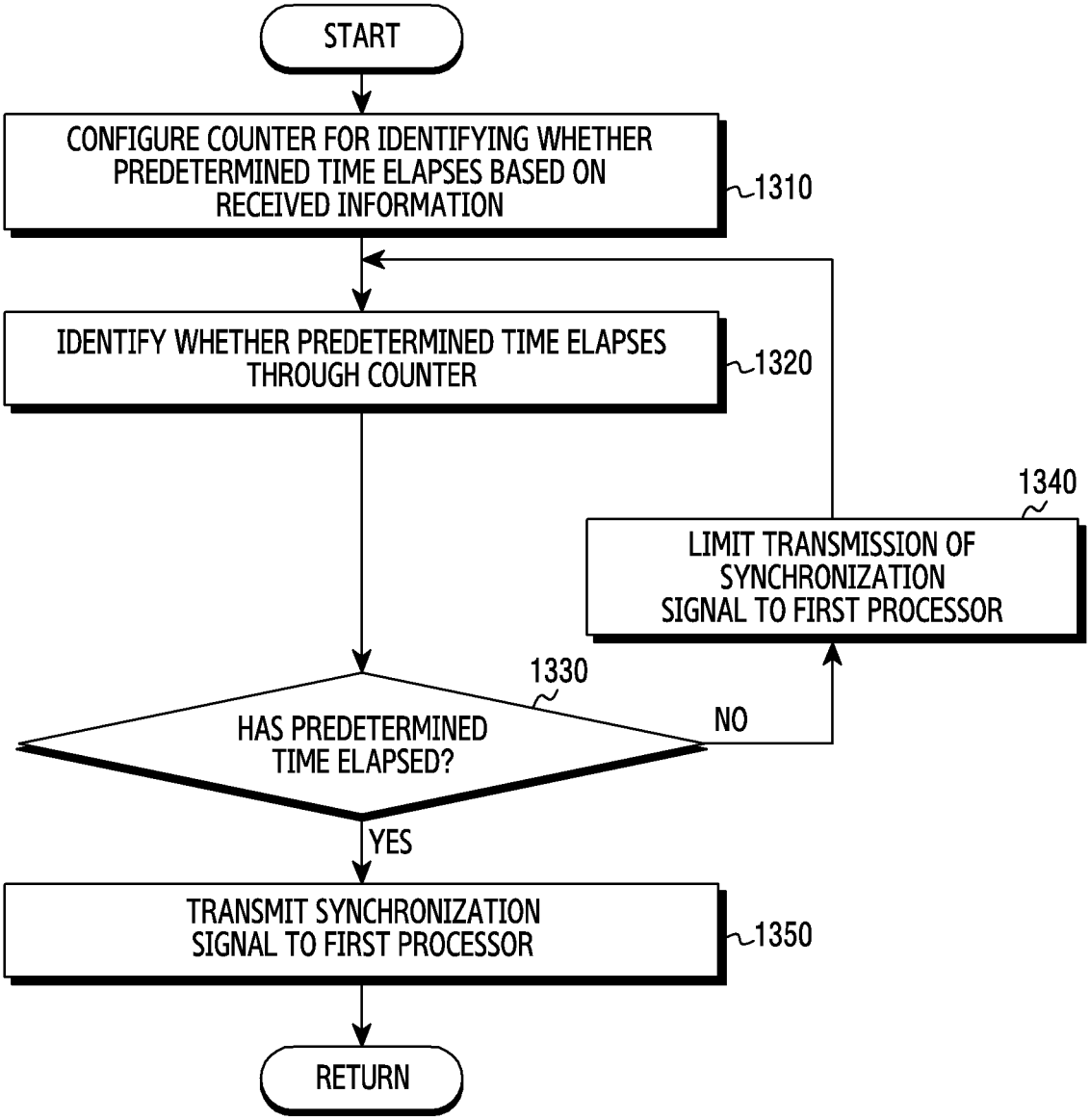
FIG. 13 illustrates another example of the operation of the electronic device for preventing storage of the received frame data according to various embodiments.

FIG. 13 illustrates another example of the operation of the electronic device for preventing storage of the received frame data according to various embodiments. The operation may be performed by the electronic device 101 illustrated in FIG. 1, the electronic device 300 illustrated in FIG. 3, the display driver IC 230 illustrated in FIG. 2, or the display-driving circuit 320 illustrated in FIG. 3.

Operations 1310 to 1350 of FIG. 13 may be associated with operation 720 of FIG. 7.

Referring to FIG. 13, in operation 1310, the display-driving circuit 320 may configure a counter for identifying whether the predetermined time has elapsed on the basis of information received from the first processor 310. According to various embodiments, operation 1310 may correspond to operation 1210 of FIG. 12.

In operation 1320, the display-driving circuit 320 may identify whether the predetermined time has elapsed through the counter. The display-driving circuit 320 may identify whether the predetermined time has elapsed by updating the counter in every frame. For example, the display-driving circuit 320 may update the counter on the basis of identification of masking transmission of the synchronization signal.

In operation 1330, the display-driving circuit 320 may determine to perform operation 1350 when it is identified that the predetermined time elapses. However, when it is identified that the predetermined time has not elapsed, the display-driving circuit 320 may determine to perform operation 1340.

In operation 1340, the display-driving circuit 320 may limit transmission of the synchronization signal to the first processor 310 on the basis of identification that the predetermined time has not elapsed. According to various embodiments, the display-driving circuit 320 may limit transmission of the synchronization signal, configured to be periodically transmitted to the first processor 310, to the first processor 310 on the basis of identification that the predetermined time has not elapsed. According to various embodiments, the display-driving circuit 320 may limit transmission of the synchronization signal by masking the synchronization signal on the basis of identification that the predetermined time has not elapsed. According to various embodiments, the display-driving circuit 320 may limit transmission of the synchronization signal to the first processor 310 by transmitting the synchronization signal to the third processor 321. In this case, the display-driving circuit 320 may update the counter on the basis of reception of the synchronization signal by the third processor 321.

In operation 1350, the display-driving circuit 320 may transmit the synchronization signal to the first processor 310 on the basis of identification that the predetermined time has elapsed. Since identification that the predetermined time has elapsed may mean that the first processor 310 completes generation of the second content to be displayed through the display panel 330, the display-driving circuit 320 may transmit the synchronization signal to the first processor 310 in order to update the frame data stored in the internal memory 322.

As described above, the electronic device 300 according to various embodiments may prevent frame data that has not been completely generated from being recorded in the internal memory 322 by controlling transmission of the synchronization signal periodically transmitted from the display-driving circuit 320 to the first processor 310 in every frame.

Figure 14:
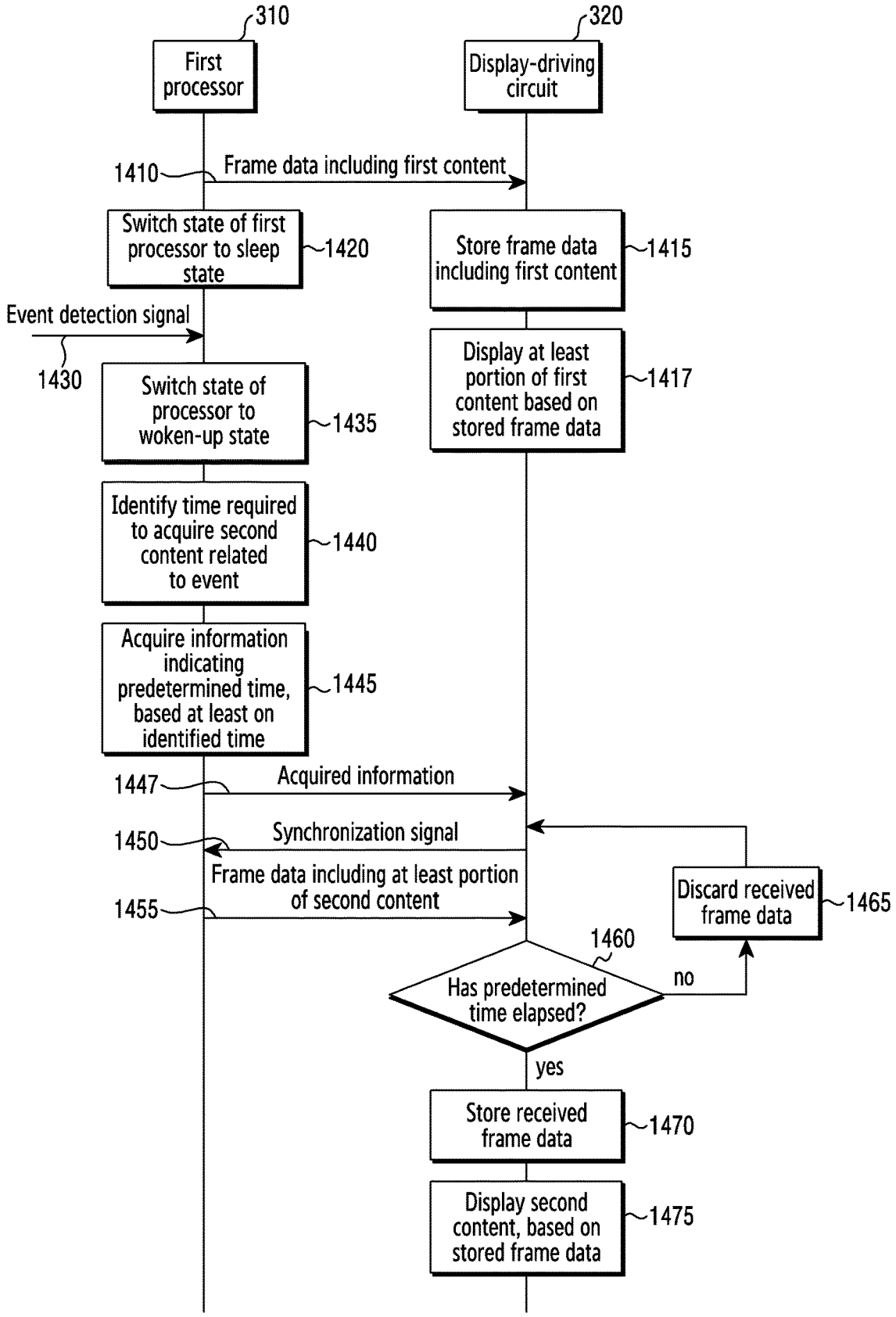
FIG. 14 illustrates another example of the operation of the electronic device according to various embodiments.

FIG. 14 illustrates another example of the operation of the electronic device according to various embodiments. The operation may be performed by the electronic device 101 illustrated in FIG. 1 or the electronic device 300 illustrated in FIG. 3.

Referring to FIG. 14, in operation 1410, the first processor 310 may transmit frame data including first content to the display-driving circuit 320. The frame data including the first content may include all of the first content. According to various embodiments, the first content may correspond to content used for providing animation. According to various embodiments, the first content may include a plurality of images associated or concatenated with each other. The plurality of images may provide animation through sequential scanning. For example, the first content may be content for the AOD self-animation mode. According to various embodiments, the first processor 310 may transmit frame data including the first content on the basis of identification of driving of the electronic device 300 in the AOD mode. The display-driving circuit 320 may receive the frame data including the first content from the first processor 310.

In operation 1415, the display-driving circuit 320 may store the frame data including the first content in the internal memory 322.

Figure 15:
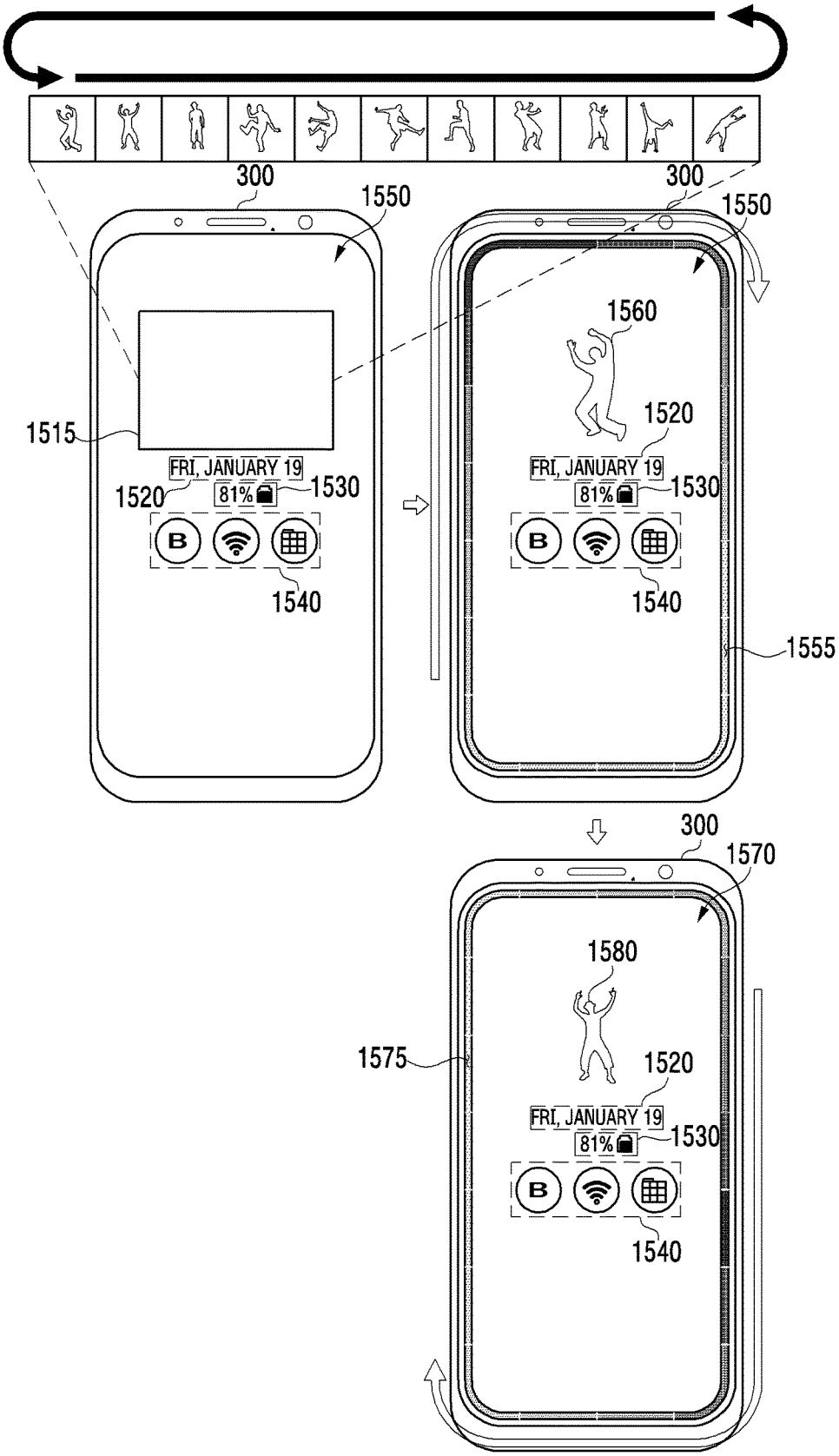
FIG. 15 illustrates an example in which an electronic device operating in an Always-On Display (AOD) mode displays second content changed from first content according to various embodiments.

In operation 1417, the display-driving circuit 320 may display at least the portion of the first content through the display panel 330 on the basis of the stored frame data. At least the portion of the first content may be displayed through the display panel 330 to provide a service related to animation in the AOD mode (for example, to provide the AOD self-animation mode). At least the portion of the first content may provide the service related to the animation without reception of frame data from the first processor 310 in the AOD mode. For example, referring to FIG. 15, the display-driving circuit 320 may display at least the portion 1510 of the first content during the AOD mode through the display panel 330 on the basis of the stored frame data. According to various embodiments, at least the portion 1510 of the first content may include a visual object 1515 for providing animation during the AOD mode. According to various embodiments, the visual object 1515 may be displayed through sequential scanning of a plurality of images included in the frame data. In the example of FIG. 15, the number of the plurality of images may be 11. However, this is not limiting. According to various embodiments, at least the portion 1510 of the first content may further include one or more of information 1520 indicating the present date, information 1530 indicating the currently remaining charge of the battery of the electronic device 300, or at least one visual object 1540 for providing a notification. According to various embodiments, one or more of the visual object 1515, the information 1520 indicating the present date, the information 1530 indicating the currently remaining charge of the battery of the electronic device 300, or at least one visual object 1540 for providing a notification may be directly generated by the display-driving circuit 320. According to various embodiments, one or more of the visual object 1515, the information 1520 indicating the present date, the information 1530 indicating the currently remaining charge of the battery of the electronic device 300, or at least one visual object 1540 for providing a notification may be displayed on the basis of the frame data received from the first processor 310.

Meanwhile, in operation 1420, the first processor 310 may switch the state of the first processor 310 from a woken-up state to a sleep state. According to various embodiments, the first processor 310 may switch the state of the first processor 310 from the woken-up state to the sleep state in order to enter the AOD mode.

In operation 1430, the first processor 310 may receive an event detection signal during the sleep state. For example, the first processor 310 may receive the event detection signal from the second processor 315. According to various embodiments, the event detection signal may indicate a change of content displayed in the AOD mode. For example, the event detection signal may be generated on the basis of reception of a message from an external electronic device.

In operation 1440, the first processor 310 may identify the time required to acquire second content related to the event. For example, operation 1440 may correspond to operation 820 of FIG. 8.

In operation 1445, the first processor 310 may acquire location information indicating a predetermined time on the basis of at least the identified time. For example, operation 1450 may correspond to operation 830 of FIG. 8.

In operation 1447, the first processor 310 may transmit the acquired information to the display-driving circuit 320. According to various embodiments, the acquired information may be used to prevent the display-driving circuit 320 from storing the frame data transmitted from the first processor 310 for the predetermined time starting at a predetermined time point. The display-driving circuit 320 may receive the acquired information. The display-driving circuit 320 may identify whether the predetermined time period has elapsed since the predetermined time point through a counter configured in the display-driving circuit 320 on the basis of the acquired information.

Meanwhile, in operation 1450, the display-driving circuit 320 may transmit the synchronization signal to the first processor 310. According to various embodiments, the synchronization signal may be transmitted to the first processor 310 at a predetermined period. The first processor 310 may receive the synchronization signal.

In operation 1455, the first processor 310 may transmit the frame data including at least a portion of the second content to the display-driving circuit 320 in response to reception of the synchronization signal. According to various embodiments, the second content may be associated with the event. According to various embodiments, the second content may correspond to content used to provide animation. According to various embodiments, the second content may be content for the AOD non-self-animation mode. According to various embodiments, the first processor 310 may transmit frame data, including at least the portion of the second content generated until the synchronization signal is received, to the display-driving circuit 320. The display-driving circuit 320 may receive the frame data including at least the portion of the second content.

In operation 1460, the display-driving circuit 320 may identify whether the predetermined time has elapsed on the basis of reception of the frame data. When the predetermined time has not elapsed, the display-driving circuit 320 may perform operation 1465. Alternatively, when it is identified that the predetermined time has elapsed, the display-driving circuit 320 may perform operation 1470.

In operation 1465, the display-driving circuit 320 may discard the received frame data on the basis of identification that the predetermined time has not elapsed. The received frame data may not be frame data that has not been completely generated, and thus the display-driving circuit 320 may discard the received frame data.

In operation 1470, the display-driving circuit 320 may store the received frame data on the basis of identification that the predetermined time has elapsed.

In operation 1475, the display-driving circuit 320 may display the second content on the basis of the stored frame data. According to various embodiments, since the display-driving circuit 320 stores the frame data received from the first processor 310 on the basis of identification that the predetermined time has elapsed and displays the second content on the basis of the stored frame data, the display-driving circuit 320 may concurrently display all of the second content. Although not illustrated in FIG. 14, the display-driving circuit 320 may receive third content related to the second content from the first processor 310 and store the third content by further performing operation similar to operations 1440 to 1475 through interworking with the first processor 310. The third content may be displayed after the second content so as to provide animation.

For example, referring to FIG. 15, the display-driving circuit 320 may display second content 1550 in place of first content 1510 through the display panel 330 during the AOD mode on the basis of the stored frame data. According to various embodiments, the second content 1550 may include a visual object 1555 indicating the event. The visual object 1555 may be concatenated with a visual object 1575 included in the third content 1570 described below. The display-driving circuit 320 may provide an animation effect by sequentially displaying the visual object 1555 and the visual object 1575. According to various embodiments, the second content 1550 may further include a visual object 1560 for providing animation. The visual object 1560 may correspond to one of a plurality of images (for example, a plurality of concatenated images included in the visual object 1515) for providing animation. The visual object 1560 may be concatenated with a visual object 1580 included in the third content 1570 described below to provide animation. The visual object 1560 may be concatenated with at least one visual object included in at least one piece of content displayed after the second content 1550 such as the visual object 1580 to provide animation.

According to various embodiments, the second content 1550 may further include one or more of the information 1520 indicating the present date, the information 1530 indicating the currently remaining charge of the battery of the electronic device 300, or at least one visual object 1540 for providing a notification. According to various embodiments, one or more of the information 1520 indicating the present date, the information 1530 indicating the currently remaining charge of the battery of the electronic device 300, or at least one visual object 1540 for providing a notification included in the second content 1550 may be directly generated by the display-driving circuit 320. According to various embodiments, one or more of the information 1520 indicating the present date, the information 1530 indicating the currently remaining charge of the battery of the electronic device 300, or at least one visual object 1540 for providing a notification included in the second content 1550 may be displayed on the basis of the frame data received from the first processor 310.

According to various embodiments, the display-driving circuit 320 may display the third content 1570 related to the second content 1550 through the display panel 330 during the AOD mode by further performing operation similar to operations 1440 to 1475 through interworking with the first processor 310. According to various embodiments, the third content 1570 may include a visual object 1555 indicating the event. The visual object 1575 may be concatenated with the visual object 1555 included in the second content 1550 displayed before the visual object 1575. The display-driving circuit 320 may provide an animation effect by sequentially displaying the visual object 1555 and the visual object 1575. According to various embodiments, the third content 1570 may further include a visual object 1580 for providing animation. The visual object 1580 may correspond to one of a plurality of images (for example, a plurality of concatenated images included in the visual object 1515) for providing animation. The visual object 1560 may be concatenated with the visual object 1560 included in the second content 1550 to provide animation. The visual object 1580 may be concatenated with at least one visual object included in at least one piece of content displayed after the third content 1570 to provide animation.

According to various embodiments, the third content 1570 may further include one or more of the information 1520 indicating the present date, the information 1530 indicating the currently remaining charge of the battery of the electronic device 300, or at least one visual object 1540 for providing a notification. According to various embodiments, one or more of the information 1520 indicating the present date, the information 1530 indicating the currently remaining charge of the battery of the electronic device 300, or at least one visual object 1540 for providing a notification included in the third content 1570 may be directly generated by the display-driving circuit 320. According to various embodiments, one or more of the information 1520 indicating the present date, the information 1530 indicating the currently remaining charge of the battery of the electronic device 300, or at least one visual object 1540 for providing a notification included in the third content 1570 may be displayed on the basis of the frame data received from the first processor 310.

A method of an electronic device (for example, the electronic device 300) according to various embodiments as described above may include an operation of receiving first frame data including at least a portion of second content from the processor while first content is displayed through the display panel, an operation of preventing storage of the received first frame data in the memory at least temporarily for a predetermined time, an operation of receiving second frame data including at least the portion of the second content from the processor after the predetermined time and storing the received second frame data in the memory, and an operation of displaying the second content through the display panel according to the second frame data.

According to various embodiments, the operation of receiving the first frame data may include an operation of receiving information related to the predetermined time from the processor and an operation of receiving the first frame data from the processor after receiving the information.

According to various embodiments, the operation of preventing storage of the first frame data may include an operation of preventing storage of the first frame data in the memory by discarding the first frame data received from the processor at least temporarily for the predetermined time.

According to various embodiments, the second frame data may be stored in the memory disposed within the display-driving circuit.

According to various embodiments, the electronic device may operate in a low-power state, the processor in the low-power state may be in a sleep state, and the method may further include an operation of limiting transmission of image data to the display-driving circuit by the processor, and may include displaying the first content on the basis of the image data stored in the memory by the display-driving circuit. For example, at least a portion of the first content may be configured as an image including a plurality of objects, and the second content may be configured as another image distinguished from the image including the plurality of objects.

According to various embodiments, the method may further include an operation of transmitting the first frame data including information on a portion of the second content to the display-driving circuit by the processor in response to reception of a synchronization signal indicating the time at which data is recorded in the memory and an operation of transmitting the second frame data including all of the content to the display-driving circuit in response to reception of the synchronization signal from the display-driving circuit after the predetermined time.

According to various embodiments, the method may further include an operation of identifying that synthesis of multiple layers is required in order to generate the second content, an operation of transmitting information indicating the predetermined time to the display-driving circuit on the basis of the identification, an operation of generating the first frame data by synthesizing a portion of the multiple layers, an operation of transmitting the first frame data to the display-driving circuit in response to reception of a synchronization signal indicating the time at which data is recorded in the memory from the display-driving circuit, an operation of identifying completion of the synthesis of the multiple layers, and an operation of transmitting the second frame data, obtained by synthesizing all of the multiple layers, to the display-driving circuit in response to reception of the synchronization signal from the display-driving circuit after the predetermined time.

According to various embodiments, the predetermined time may correspond to at least one frame.

According to various embodiments, the method may further include an operation of identifying the number of a plurality of objects included in the second content by the processor, an operation of identifying the predetermined time on the basis of the number of the plurality of objects, and an operation of transmitting information indicating the predetermined time to the display-driving circuit.

A method of an electronic device (for example, the electronic device 300) according to various embodiments as described above may include an operation of displaying first content by a display-driving circuit of the electronic device, an operation of receiving a command indicating a delay time from a processor of the electronic device by the display-driving circuit, an operation of discarding first frame data on second content received from a processor of the electronic device for the delay time starting from a predetermined time by delaying activation of the memory for the delay time starting from the predetermined time by the display-driving circuit, an operation of generating a signal for activating the memory after the delay time from the predetermined time by the display-driving circuit, an operation of storing second frame data on the second content received from the processor after the delay time from the predetermined time in the memory activated on the basis of the signal by the display-driving circuit, and an operation of displaying the second content changed from the first content on the basis of the stored second frame data by the display-driving circuit.

According to various embodiments, the method may further include an operation of displaying the first content while the display-driving circuits discard the first frame data.

According to various embodiments, the memory may be configured to store third frame data on the first content while the first frame data is discarded.

According to various embodiments, each of the first frame data and the second frame data may include at least one of an instruction of 2Ch of a Mobile Industry Processor Interface (MIPI) standard or an instruction of 3Ch of the MIPI standard, and the command may include an instruction different from the instruction of 2Ch and the instruction of 3Ch, among instructions from 00h to FFh of the MIPI standard.

According to various embodiments, the operation of identifying that the delay time elapses may include an operation of configuring a counter value on the basis of the delay time indicated by the command by the display-driving circuit, an operation of identifying a designated command from the first frame data received from the processor by the display-driving circuit, an operation of changing the counter value on the basis of the identification by the display-driving circuit, and an operation of identifying that the delay time elapses from the predetermined time by identifying that the changed counter value reaches a predetermined value by the display-driving circuit. According to various embodiments, the size of the second content included in the first frame data may be smaller than the size of the second content included in the second frame data.

According to various embodiments, the predetermined time may be related to the time at which a synchronization signal indicating the time at which data is recorded in the memory is transmitted from the display-driving circuit to the processor.

A method of an electronic device according to various embodiments as described above may include an operation of storing first frame data in the memory after a first time elapses from the time at which the first frame data related to first content is initially received from a processor of the electronic device by a display-driving circuit of the electronic device and an operation of storing second frame data in the memory after a second time different from the first time elapses from a time at which the second frame data related to second content, different from the first content, is initially received from the processor by the display-driving circuit.

According to various embodiments, the configuration of the second content may be different from the configuration of the first content.

According to various embodiments, the load on the processor at the time at which the first frame data is acquired may be different from the load on the processor at the time at which the second frame data is acquired.

Methods disclosed in the claims and/or methods according to various embodiments described in the specification of the disclosure may be implemented by hardware, software, or a combination of hardware and software.

When the methods are implemented by software, a computer-readable storage medium for storing one or more programs (software modules) may be provided. The one or more programs stored in the computer-readable storage medium may be configured for execution by one or more processors within the electronic device. The at least one program may include instructions that cause the electronic device to perform the methods according to various embodiments of the disclosure as defined by the appended claims and/or disclosed herein.

The programs (software modules or software) may be stored in non-volatile memories including a random access memory and a flash memory, a read only memory (ROM), an electrically erasable programmable read only memory (EEPROM), a magnetic disc storage device, a compact disc-ROM (CD-ROM), digital versatile discs (DVDs), or other type optical storage devices, or a magnetic cassette. Alternatively, any combination of some or all of them may form a memory in which the program is stored. Further, a plurality of such memories may be included in the electronic device.

In addition, the programs may be stored in an attachable storage device which may access the electronic device through communication networks such as the Internet, Intranet, Local Area Network (LAN), Wide LAN (WLAN), and Storage Area Network (SAN) or a combination thereof. Such a storage device may access the electronic device via an external port. Further, a separate storage device on the communication network may access a portable electronic device.

In the above-described detailed embodiments of the disclosure, an element included in the disclosure is expressed in the singular or the plural according to presented detailed embodiments. However, the singular form or plural form is selected appropriately to the presented situation for the convenience of description, and the disclosure is not limited by elements expressed in the singular or the plural. Therefore, either an element expressed in the plural may also include a single element or an element expressed in the singular may also include multiple elements.

Although specific embodiments have been described in the detailed description of the disclosure, various modifications and changes may be made thereto without departing from the scope of the disclosure. Therefore, the scope of the disclosure should not be defined as being limited to the embodiments, but should be defined by the appended claims and equivalents thereof.

The invention claimed is:

1. An electronic device comprising:

a display panel;

a processor; and a display-driving circuit comprising a memory and configured to drive the display panel, wherein the display-driving circuit is configured to:

receive first frame data including some portion of second content from the processor while first content is displayed through the display panel, prevent storage of the received first frame data in the memory by discarding the first frame data at least temporarily for a predetermined time, receive second frame data including all portions of the second content from the processor after the predetermined time, store the received second frame data in the memory, and display the second content through the display panel according to the second frame data, wherein the second content corresponding to the second frame data includes one or more visual objects for providing animation, and wherein the processor is configured to:

identify a count of the one or more visual objects included in the second content corresponding to the second frame data, identify the predetermined time based on the count of the one or more visual objects, and transmit information indicating the predetermined time to the display-driving circuit.

2. The electronic device of claim 1, wherein the display-driving circuit is configured to receive the information related to the predetermined time from the processor and receive the first frame data from the processor after receiving the information.

3. The electronic device of claim 1, wherein the memory is disposed within the display-driving circuit.

4. The electronic device of claim 1, wherein the electronic device operates in a low-power state, the processor in the low-power state is in a sleep state and is configured to limit transmission of image data to the display-driving circuit, and the display-driving circuit is configured to display the first content, based on the image data stored in the memory.

5. An electronic device comprising:

a display panel;

a display-driving circuit, which comprises a memory and is operatively coupled to the display panel; and a processor operatively coupled to the display-driving circuit, wherein the display-driving circuit is configured to:

display first content, receive a command indicating a delay time from the processor, discard first frame data on second content received from the processor for the delay time starting from a predetermined time by delaying activation of the memory for the delay time starting from the predetermined time, generate a signal for activating the memory after the delay time from the predetermined time, store second frame data on the second content received from the processor after the delay time from the predetermined time in the memory activated based on the signal, and display the second content changed from the first content, based on the stored second frame data, wherein the first frame data includes some portion of the second content and the second frame data includes all portions of the second content, and wherein the second content corresponding to the second frame data includes one or more visual objects for providing animation, and wherein the processor is configured to:

identify a count of the one or more visual objects included in the second content corresponding to the second frame data, identify the delay time based on the count of the one or more visual objects, and transmit information indicating the delay time to the display-driving circuit.

6. The electronic device of claim 5, wherein the display-driving circuit is further configured to display the first content while the first frame data is discarded.

7. The electronic device of claim 5, wherein the memory is configured to store third frame data on the first content while the first frame data is discarded.

8. The electronic device of claim 5, wherein each of the first frame data and the second frame data includes at least one of an instruction of 2Ch of a Mobile Industry Processor Interface (MIPI) standard or an instruction of 3Ch of the MIPI standard, and the command includes an instruction different from the instruction of 2Ch and the instruction of 3Ch among instructions from 00h to FFh of the MIPI standard.

9. The electronic device of claim 5, wherein the display-driving circuit is configured to configure a counter value based on the delay time indicated by the information, identify a designated command from the first frame data received from the processor, change the counter value based on the identification, and identify that the delay time elapses since the predetermined time by identifying that the changed counter value reaches a predetermined value.

10. The electronic device of claim 9, wherein a size of the second content included in the first frame data is smaller than a size of the second content included in the second frame data.

11. The electronic device of claim 5, wherein the predetermined time is related to a time at which a synchronization signal indicating a time at which data is recorded in the memory is transmitted from the display-driving circuit to the processor.

12. An electronic device comprising:

a display panel;

a display-driving circuit, which comprises a memory and is operatively coupled to the display panel; and a processor operatively coupled to the display-driving circuit, wherein the display-driving circuit is configured to:

store first frame data in the memory after a first time elapses from a time at which the first frame data related to first content is initially received from the processor; and store second frame data in the memory after a second time different from the first time elapses from a time at which the second frame data related to second content different from the first content is initially received from the processor, and wherein the first content includes one or more first visual objects for providing animation, and the second content includes one or more second visual objects concatenated with the one or more first visual objects to provide the animation, and wherein the processor is configured to:

identify a count of the one or more first visual objects included in the first content, identify the first time based on the count of the one or more first visual objects, transmit a first information indicating the first time to the display-driving circuit, identify a count of the one or more second visual objects included in the second content, identify the second time based on the count of the one or more second visual objects, and transmit a second information indicating the second time to the display-driving circuit.

13. The electronic device of claim 12, wherein a configuration of the second content is different from a configuration of the first content.

14. The electronic device of claim 12, wherein a load on the processor at a time at which the first frame data is acquired is different from a load on the processor at a time at which the second frame data is acquired.

* * * * *